US007444093B2

(12) United States Patent
Abe et al.

(10) Patent No.: US 7,444,093 B2
(45) Date of Patent: Oct. 28, 2008

(54) LIQUID TONER CONCENTRATION DETECTING DEVICE AND METHOD WITH WINDOW IN TONER CONTAINER FOR LIGHT PASSAGE

(75) Inventors: Nobumasa Abe, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 305 days.

(21) Appl. No.: 11/349,740

(22) Filed: Feb. 8, 2006

(65) Prior Publication Data

US 2006/0188278 A1 Aug. 24, 2006

(30) Foreign Application Priority Data

| | | |
|---|---|---|
| Feb. 10, 2005 | (JP) | P2005-033919 |
| Feb. 10, 2005 | (JP) | P2005-033920 |
| Mar. 9, 2005 | (JP) | P2005-065163 |
| Mar. 9, 2005 | (JP) | P2005-065164 |

(51) Int. Cl.
*G03G 15/10* (2006.01)

(52) U.S. Cl. ..... 399/57; 399/238

(58) Field of Classification Search ..... 399/57, 399/237, 238

See application file for complete search history.

(56) References Cited

U.S. PATENT DOCUMENTS

| | | | | |
|---|---|---|---|---|
| 5,530,528 | A * | 6/1996 | Houki et al. | 399/61 |
| 5,860,041 | A * | 1/1999 | Tanaka et al. | 399/65 |
| 6,278,850 | B1 * | 8/2001 | Park | 399/57 |
| 6,311,034 | B1 * | 10/2001 | Nakashima et al. | 399/239 |
| 7,171,143 | B2 * | 1/2007 | Yamasaku | 399/237 |
| 2004/0264985 | A1 * | 12/2004 | Hamby et al. | 399/30 |

FOREIGN PATENT DOCUMENTS

| | | | |
|---|---|---|---|
| JP | 56081871 | * | 7/1981 |
| JP | 60080879 | A * | 5/1985 |
| JP | 60105948 | A * | 6/1985 |
| JP | 02176684 | A * | 7/1990 |
| JP | 03120569 | A * | 5/1991 |
| JP | 04019773 | A * | 1/1992 |
| JP | 11258916 | A * | 9/1999 |
| JP | 2001-005300 | | 1/2001 |
| JP | 2001-356608 | | 12/2001 |

* cited by examiner

*Primary Examiner*—Quana M Grainger
(74) *Attorney, Agent, or Firm*—Hogan & Hartson LLP

(57) ABSTRACT

A first container is operable to accommodate a liquid toner, and provided with a window. A reflector is disposed in the first container. A light emitter is operable to emit light to the reflector through the window and the liquid toner. A light receiver is operable to receive the light reflected by the reflector through the liquid toner and the window. A detector is operable to detect a concentration of the liquid toner based on the light received by the light receiver.

15 Claims, 14 Drawing Sheets

LIQUID TONER CONCENTRATION DETECTING DEVICE AND METHOD WITH WINDOW IN TONER CONTAINER FOR LIGHT PASSAGE

BACKGROUND OF THE INVENTION

The present invention relates to a liquid toner concentration detecting device which detects the concentration of solid particles in liquid toner used in a developing process for an image carrier with an electrostatic latent image formed on a photosensitive layer, as well as an image forming apparatus and a method of controlling concentration which utilize the detecting device.

An electronic photographic type image forming apparatus includes a liquid toner including a liquid carrier such as an organic solvent, silicon oil, mineral oil or edible oil in which microscopic toner resin particles containing a pigment have been dispersed.

In the electronic photographic type image forming apparatus using the liquid toner, a laser beam is scanned over the surface of an image carrier such as a photoreceptor, to form an electrostatic latent image, and the electrostatic latent image is developed by a liquid toner containing toner and a liquid carrier mixed at a predetermined ratio, thus forming a toner image.

A liquid toner developing device is configured as follows. That is, in order to form a high quality image, the concentration of toner particles in the liquid toner is measured and, in the event that the concentration of toner particles decreases due to the developing process, the concentration of toner in the liquid toner is maintained within a predetermined range by replenishing the concentrated liquid which has a high concentration of toner particles.

According to JP-A-2001-356608, a liquid toner concentration detecting device is disclosed in which a detecting head is disposed inside a tank storing a liquid toner, the detecting head is connected to a light emitter and a light receiver by means of fiber cables, the light emitted by the light emitter is injected into the liquid toner through the injection aperture of the detecting head, one part of the injected light is dispersed by the toner particles in the liquid toner, injected into the light receiving aperture of the detecting head, and received by the receiver, and the concentration of the liquid toner is detected according to the amount of the received light.

Furthermore, according to JP-A-2001-5300, a liquid toner concentration detecting device is disclosed in which a housing is disposed in liquid toner supplier which is connected to a liquid toner storage tank and a developer, and the housing is provided with liquid toner oil film forming means which forms a film of liquid toner oil inside the housing, a light source unit which emits colored light, of a wavelength of relatively low light transmissivity vis-à-vis a selected color liquid toner, to the liquid toner oil film of the selected color liquid toner, and a light detector which receives the light transmitted through the liquid toner oil film from the light source unit.

In recent years, in response to requests for compact image forming apparatuses which the users themselves can install and move as they wish within the office, and for a higher quality of output image, there has been a demand for the introduction to the office of image forming apparatuses which utilize liquid toner, which have toner particles of a smaller diameter than those of dry toner, to obtain high quality images. In meeting these demands, it can be predicted that the image forming apparatus will be subjected to tilting and vibration when being installed or moved. For this reason, in the case of the liquid toner concentration detecting device disclosed according to JP-A-2001-5300, if the image forming apparatus is tilted when installed or moved, or is subjected to vibration, there is a danger of losing the required detection accuracy due to liquid toner adhering to the light detector itself, or to a detecting window disposed in the front of the light detector. Furthermore, in the case of the liquid toner concentration detecting device disclosed according to JP-A-2001-356608, in some cases it can be predicted that the volume of liquid toner in the tank decreases below a predetermined volume, the detecting head is exposed making detection impossible, or that the liquid toner adhering to the tip of the exposed detecting head will harden, so that the detecting function will not be restored even if the liquid toner is replenished.

Furthermore, in the case of the image forming apparatus using a liquid toner including a liquid carrier in which microscopic toner resin particles containing a pigment have been dispersed, in some cases, a large number of toner resin particles are consumed when forming a photographic image, and a large amount of liquid carrier is consumed when forming letter images, meaning that in order to obtain a high quality image, it is essential to constantly maintain the mixture ratio of the toner resin particles and the liquid carrier at a substantially fixed level.

SUMMARY

It is therefore an object of the invention to provide a simply configured liquid toner concentration detecting device, enabling consistently stable and highly accurate liquid toner concentration detection, as well as an image forming apparatus and a method of controlling a concentration of liquid toner which utilize the detecting device.

In order to achieve the object, according to the invention, there is provided a liquid toner concentration detecting device comprising:

a first container, operable to accommodate a liquid toner, and provided with a window;

a reflector, disposed in the first container;

a light emitter, operable to emit light to the reflector through the window and the liquid toner;

a light receiver, operable to receive the light reflected by the reflector through the liquid and the window; and a detector, operable to detect a concentration of the liquid toner based on the light received by the light receiver.

The reflector may be rotatable.

The first container may have a first surface provided with the window, the reflector may have a second surface, a curvature of the first surface may be different from a curvature of the second surface, the window of the first surface may be adjacent to the second surface, and the light emitter and the light receiver may face the window.

The reflector may have a slider operable to be brought in sliding contact with the window.

The reflector may be operable to agitate the liquid toner in the first container.

The first container may be communicated with a development device, which has a second container adapted to accommodate the liquid toner and a developer causing the liquid toner to adhere onto an image carrier to develop an electrostatic latent image formed on the image carrier as a toner image.

The first container may be communicated with the second container through a flow path.

The first container may be communicated with a first tank adapted to store a first liquid, and the first container may be communicated with a second tank adapted to store a second liquid.

The first liquid may be a concentrated toner, and the second liquid may be a carrier liquid.

The first container may be identical with the second container.

The reflector may be operable to supply the liquid toner to the developer.

A supply roller may be formed with a groove adapted to accommodate the liquid toner and is operable to supply the liquid toner to the developer, and a part of the supply roller, not having the groove, may serve as the reflector.

According to the invention, there is also provided an image forming apparatus in which an electrostatic latent image formed on an image carrier is developed as toner image, the image forming apparatus comprising the liquid toner concentration detecting device.

According to the invention, there is also provided a method of controlling concentration of liquid toner comprising: providing the liquid toner concentration detecting device; detecting a signal, which shows the concentration of the liquid toner and is generated by the detector; counting a number of first times a value of each of a plurality of the signal exceeds a preset upper limit within a predetermined time period; counting a number of second times a value of each of a value of each of a plurality of the signal exceeds a preset lower limit within the predetermined time period; supplying the first container with a concentrated toner in a case where the number of the first times is greater than a predetermined number of times; and supplying the first container with a carrier liquid in a case where the number of the first times is no more than the predetermined number of times and the number of the second times is greater than the predetermined number of times.

According to the invention, there is also provided a method of controlling concentration of liquid toner comprising: providing the liquid toner concentration detecting device; detecting a signal, which shows the concentration of the liquid toner and is generated by the detector, within a predetermined time period; calculating an average value of values of a plurality of the signal; supplying the first container with a concentrated toner in a case where the average value is greater than a preset upper limit; and supplying the first container with a carrier liquid in a case where the average value is no more than the preset upper limit and the average value is less than a preset lower limit.

According to the invention, there is also provided a method of controlling concentration of liquid toner comprising: providing the liquid toner concentration detecting device; detecting a signal, which shows the concentration of the liquid toner and is generated by the detector, within a predetermined time period; calculating an integrated value of values of a plurality of the signal; supplying the first container with a concentrated toner in a case where the integrated value is greater than a preset upper limit; and supplying the first container with a carrier liquid in a case where the integrated value is no more than the preset upper limit and the integrated value is less than a preset lower limit.

According to the invention, there is also provided a method of controlling concentration of liquid toner comprising: providing the liquid toner concentration detecting device; detecting a signal, which shows the concentration of the liquid toner and is generated by the detector; detecting a time period for which a value of the signal is greater than a standard value; calculating an average time period of a plurality of the time period; supplying the first container with a concentrated toner in a case where the average time period is greater than a preset upper limit; and supplying the first container with a carrier liquid in a case where the average time period is no more than the preset upper limit and the average time period is less than a preset lower limit.

According to the invention, there is also provided a method of controlling concentration of liquid toner comprising: providing the liquid toner concentration detecting device; detecting a signal, which shows the concentration of the liquid toner and is generated by the detector; detecting a time period for which a value of the signal is greater than a standard value; calculating a total time period of a plurality of the time period; supplying the first container with a concentrated toner in a case where the total time period is greater than a preset upper limit; and supplying the first container with a carrier liquid in a case where the total time period is no more than the preset upper limit and the total time period is less than a preset lower limit.

According to the invention, there is also provided a liquid toner detecting device comprising:

a container, adapted to accommodate liquid toner, and provided in a developing device causing the liquid toner to adhere onto an image carrier to develop an electrostatic latent image formed on the image carrier as a toner image;

a roller, disposed in the container, and having a flat surface at one end portion of the roller and a drive gear at the other end portion;

a reflective photo sensor, disposed outside of the container, and facing the roller, wherein the reflective photo sensor emits light to the flat surface of the roller through the liquid toner, the flat surface of the roller reflects the light to the reflective photo sensor, and the reflective photo sensor receives the light reflected by the flat surface of the roller though the liquid toner and detects a concentration of the liquid toner based on the light.

DETAIL DESCRIPTION OF PREFERRED EMBODIMENTS

Figure 1:
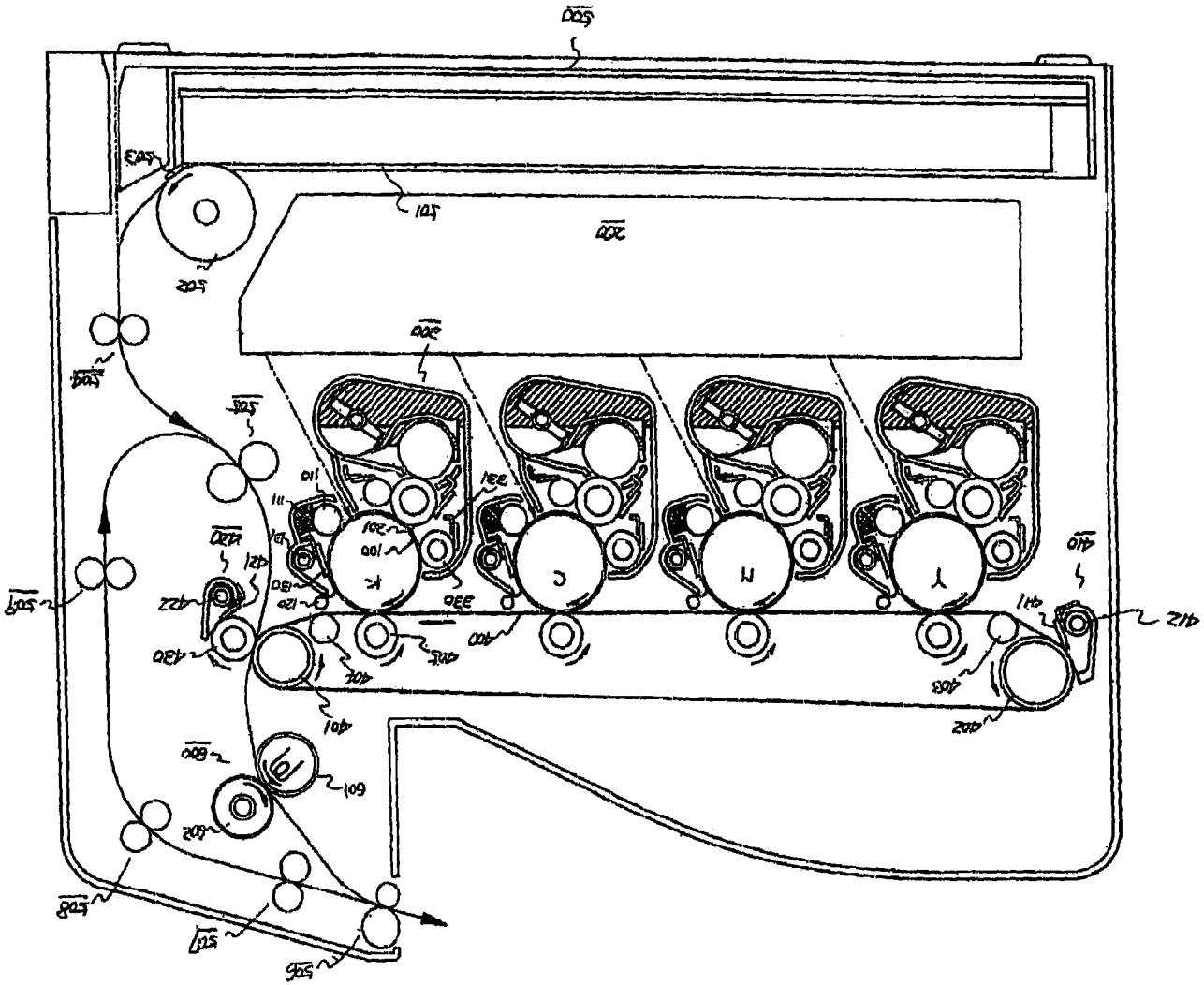
FIG. 1 is a view showing the overall configuration of an image forming apparatus of the invention.

Embodiments of the invention will be described with reference to the drawings. FIG. 1 shows the overall configuration of one embodiment of an image forming apparatus equipped with a liquid toner concentration detecting device of the invention. As shown in FIG. 1, in the image forming apparatus of this embodiment, image forming sections Y, M, C and K, which are utilized for yellow, magenta, cyan and black respectively, are arranged in tandem below an intermediary transfer belt 400 stretched across a drive roller 401, a cleaner back up roller 402 and auxiliary rollers 403 and 404.

The image forming process of the image forming apparatus of this embodiment will be described using the black image forming section K as a representative. As the yellow, magenta and cyan image forming sections Y, M and C have the same configuration as the black image forming section, the descriptions thereof will be omitted.

The surface of a photoreceptor 100, which is an organic photoreceptor or an amorphous silicon photoreceptor, is charged uniformly by a charging roller 110 which rotates in contact with the photoreceptor 100 while being impressed by a power source (not shown) with a bias of the same polarity as that of the liquid toner's charged polarity.

The charging roller 110 suitably uses an elastic roller having the surface of a metal shaft covered with an elastic material such as conductive urethane rubber and a fluoride resin surface layer. Furthermore, dirt is removed from the charging roller 110 by bringing a cleaning pad 111 into sliding contact with it.

Next, a black image electrostatic latent image is imprinted on the uniformly charged photoreceptor 100 by means of a laser scanning optical system 200 installed below each color image forming section.

Figure 2:
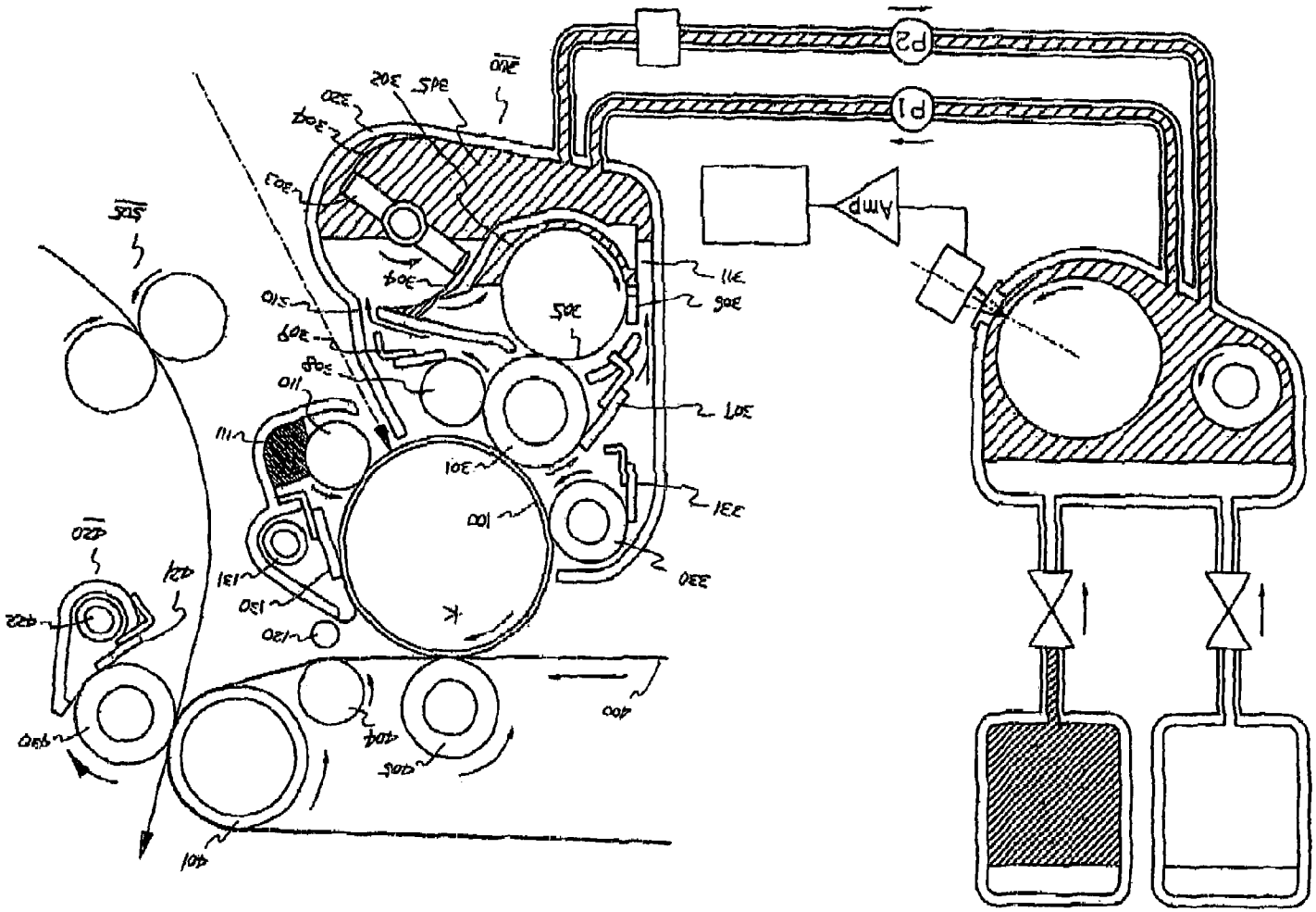
FIG. 2 is a partial enlarged view of a black image forming section in FIG. 1.

Meanwhile, inside a developing device 300, a uniform layer of toner is formed on a developing roller 301 by means of the configuration hereafter illustrated in FIG. 2. The developing roller 301, which has been impressed by a power source (not shown) with a developing bias of the same polarity as that of the liquid toner's charged polarity, rotates in contact with the black image electrostatic latent image formed on the photoreceptor 100, causing a visible image of the black image electrostatic latent image to be formed by the toner.

The liquid toner used for this embodiment includes solid thermoplastic resin particles of average diameter 1 μm in which a coloring agent such as a pigment has been dispersed, dispersed at approximately 20% weight in a liquid solvent such as organic solvent, silicon oil, mineral oil or edible oil, while adding a dispersing agent.

The developing roller 301 is suitably structured to have the outer periphery of a metal shaft covered with an elastic material, such as conductive urethane rubber, and a layer of resin or a layer of rubber.

Immediately after formation by the developing roller 301, the liquid toner image on the photoreceptor 100 includes a high ratio of liquid solvent, meaning that there is a possibility of image deletion when colors are layered over one another on the intermediate transfer belt 400 by means of the transfer device, to be described later. As such, the excess liquid solvent is transferred onto the squeezing roller 330, which rotates in contact with the photoreceptor 100 while being impressed with a bias of the same polarity as the toner's charging characteristics, thus raising the ratio of solid particles in the visible image. The liquid solvent transferred to the squeezing roller 330 is scratched off by a squeezing roller cleaner 331.

The squeezing roller 330 suitably uses an elastic roller having the surface of a metal shaft covered with an elastic material such as conductive urethane rubber and a fluoride resin surface layer.

Next, by impressing a bias, with a power source (not shown), of opposite polarity to the toner's charging characteristics, to a primary transfer roller 405 which rotates in contact via the intermediate transfer belt 400, the visible image on the photoreceptor 100 is primarily transferred to the intermediate transfer belt 400, where it is superimposed on the visible image of another color which has been formed on the upstream side of the intermediate transfer belt 400 in its rotating direction by means of the same image forming process, thus creating a full color image.

After the primary transfer, the electrostatic latent image is removed from the photoreceptor 100 by a neutralizing lamp 120, which includes a rod-shaped light source, liquid toner remaining from the primary transfer is scratched off by a photoreceptor cleaning blade 130 which is in contact with the photoreceptor 100, and the photoreceptor 100 is once more charged uniformly by the charging roller 110.

The used liquid toner scratched off by the photoreceptor cleaning blade 130 is carried towards the back of FIG. 1 by a carrying screw 131, and collected in a waste toner container (not shown).

The color visible images formed on the intermediate transfer belt 400 proceed to a secondary transfer section, including the intermediate transfer belt 400, the drive roller 401 and a secondary transfer roller 430.

In synchronization with the timing of the image formation, one of recording media 501, such as sheets of paper, stacked in a paper feed cassette 500 is separated by a pick up roller 502 and a separating pad 503, and fed to the secondary transfer section via a feed roller pair 504 and a resist roller pair 505, which corrects the angle of the recording medium and the feed timing.

The secondary transfer roller 430 is biased towards the drive roller 401 via the intermediate transfer belt 400 by biasing means (not shown), and at the same time a bias of opposite polarity to the liquid toner's charging characteristics is impressed by a power source (not shown), resulting in the secondary transfer of the full color image on the intermediate transfer belt 400 to the recording medium 501.

Paper scraps, which have adhered to the surface of a secondary transfer roller 430, and liquid toner, which has adhered to the secondary transfer roller 430 from a portion of the intermediate belt 400 between the adjacent recording media, are scratched off by a secondary transfer roller cleaning blade 421 which is included in a secondary transfer roller cleaner 420 and is in contact with the secondary transfer roller 430. The paper scraps and liquid toner scratched off by the secondary transfer roller cleaning blade 421 are carried towards the back of FIG. 1 by the carrying screw 422, and collected in a waste toner container (not shown).

After the secondary transfer, the secondary transfer residual toner and paper scraps remaining on the surface of the intermediate transfer belt 400 are scratched off by a belt cleaning blade 411, in a belt cleaner 410 which is in contact with the cleaner back up roller 402 via the intermediate transfer belt 400. The secondary transfer residual toner and paper scraps scratched off by the belt cleaning blade 411 are carried towards the back of FIG. 1 by the carrying screw 412, and collected in a waste toner container (not shown).

The recording medium 501 bearing the secondarily transferred full color image passes through a fixing device 600, including a internal heater-equipped heat roller 601 and a pressurizing roller 602 covered in an elastic material such as rubber, whereby the thermoplastic resin included in the full color image is fused and pressure-fixed onto the recording medium 501, providing the required image.

After fixing, the recording medium 501 is discharged by means of a paper discharge roller pair 506 onto the upper surface of the image forming apparatus. When an image is also to be formed on the reverse side of the recording medium 501, the recording medium 501 is switched back by the paper discharge roller pair 506 capable of forward and backward rotation, and the image is once more transferred, via the resist rollers 505 by refeed roller pairs 507, 508 and 509, to the reverse side of the recording medium 501 in the secondary transfer section. After the image is fixed by the fixing device 600, the recording medium 501 is discharged onto the upper surface of the image forming apparatus by means of the paper discharge roller pair 506.

FIG. 2 is a partial enlarged view of the black image forming section K of the image forming apparatus shown in FIG. 1. The configuration of the developing device of the image forming apparatus of the invention will be described with reference to FIG. 2.

The developing device 300 includes a liquid toner primary reservoir 315 in the lower part of the container 320. The reservoir 315 is equipped with an agitator 303 which includes a flexible plate-shaped agitating member 304.

The plate-shaped agitating member 304 includes a flexible metal plate such as stainless steel or phosphor bronze and a flexible resin plate such as polyethylene terephthalate. The free end of the plate-shaped agitating member 304 is configured to come into sliding contact with the inner periphery of the container 320 in the primary reservoir 315, where the agitator 303 rotates, thereby agitating the liquid toner, while at the same time lifting the liquid toner into a secondary reservoir 302.

The liquid toner, which is lifted into the secondary reservoir 302 and overflows, drops into the primary reservoir under its own weight.

The secondary reservoir 302 includes a toner supply roller 305 which has on its surface microscopic grooves such as spiral grooves. A toner regulating blade 306, which includes a flexible metal plate with urethane rubber on its tip in contact with the rotating toner supply roller 305, scratches off and accommodates the liquid toner into the grooves on the surface of the toner supply roller 305.

The liquid toner accommodated inside the grooves on the surface of the toner supply roller 305 is transferred to the surface of the developing roller 301 by being brought into contact with the developing roller 301, which has the surface of a metal shaft covered with an elastic material such as conductive urethane rubber. A leveling roller 308, which rotates in contact with the developing roller 301 and is impressed with a bias of a polarity equivalent to that of the liquid toner and higher than that of the developing roller 301 by a power source (not shown), obliterates the groove pattern on the toner supply roller 305 surface, and creates a uniform film of liquid toner.

The leveling roller 308 is suitably structured to include a metal roller or a metal roller with a conductive resin layer and rubber layer on its surface. Furthermore, in the case of this embodiment, the leveling roller 308 is configured to rotate counter to the rotating direction of the developing roller 301, but by incorporating a speed difference in relation to the peripheral speed of the developing roller 301, it can be configured to rotate in the driven direction.

By impressing the leveling roller 308 with a bias of a polarity equivalent to that of the liquid toner and higher than that of the developing roller 301, the solid particles in the liquid toner on the developing roller 301 transfer to the surface layer of the developing roller 301, causing soft binding. This soft binding has the effect of increasing the speed of the transfer of the solid particles in the liquid toner from the developing roller 301 to the latent image section of the photoreceptor 100 by means of the developing nip part of the developing roller 301, which is in contact with the photoreceptor 100, thus increasing the concentration of the image.

A leveling roller blade 309 is in contact with the leveling roller 308 counter to the rotating direction of the leveling roller 308, thus scraping off the liquid toner adhering to the leveling roller 308. The liquid toner scratched off by the leveling roller blade 309 is returned by its own weight to the primary reservoir 315 via a collecting opening 310.

The surface of the developing roller 301 is cleaned by bringing the developing roller blade 307 into contact with the surface of the developing roller 301 downstream of the developing nip part, thus scraping off the liquid toner remaining after development. The liquid toner scratched off by the developing roller blade 307 is returned by its own weight to the primary reservoir 315 via a collecting pathway 311.

The liquid toner returned to the primary reservoir 315 via the collecting opening 310 and collecting pathway 311 is agitated by the agitator 303, and lifted again into the secondary reservoir 302.

Figure 3:
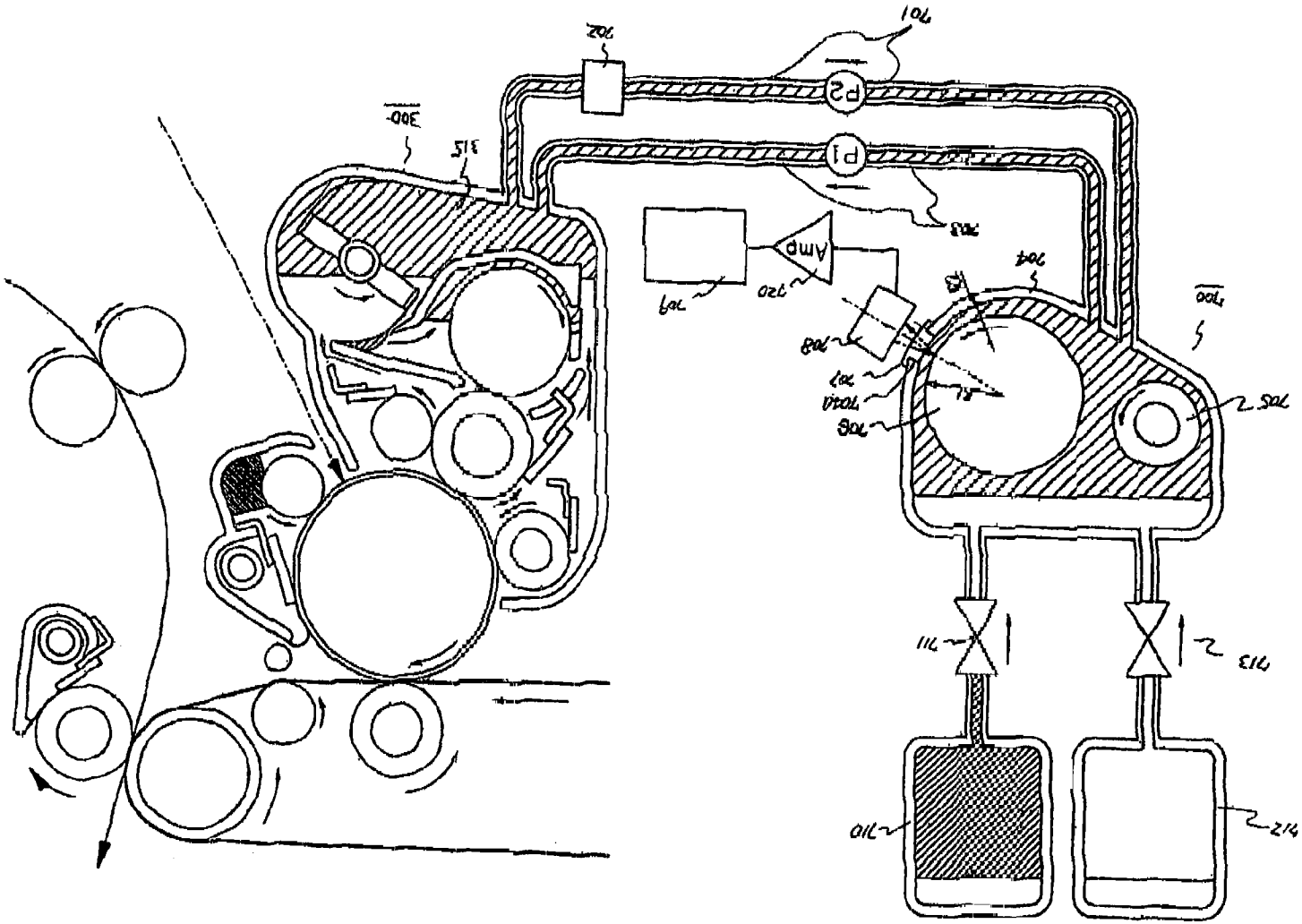
FIG. 3 is a view showing embodiment 1 of a liquid toner concentration detecting device of the invention.

FIG. 3 is a sectional view showing embodiment 1 of the liquid toner concentration detecting device of the invention. As shown in FIG. 3, a liquid toner concentration detecting device 700 is in communication with the developing device 300 through a toner back-flow path 701 and a toner supply path 703. The liquid toner is conveyed by pumps P1 and P2, while the toner back-flow path 701 is equipped with a filter 702, which removes any large solid particles in the toner as well as any foreign object which has mixed in with the toner for whatever reason.

Although the configuration of the embodiment is such that the liquid toner is conveyed by the pumps P1 and P2, either pump P1 or P2 can be replaced with a valve in the event that it is possible to install the liquid toner concentration detecting device 700 at a level different to that of the toner surface in the primary reservoir 315 of the developing device 300. Tube pumps, diaphragm pumps or gear pumps can be used for the pumps P1 and P2.

The inside of a casing 704 where the liquid toner is stored is equipped with an agitating screw 705, which agitates the liquid toner, and an agitating roller 706. The outer periphery of the agitating roller 706 and the inner surface of the casing 704 have different curvatures R1 and R2, and they are preferably set so that the distance between the two is preferably 0.5 mm or less or, in the case of a liquid toner of high concentration, 0.1 mm or less. Furthermore, the surface of the agitating roller 706 preferably includes a metal, metal plating, or the like so as to have a high degree of reflectivity.

The casing 704 is provided with an opening 704*a* at the point at which the inner surface of the casing 704 comes in closest proximity with the outer periphery of the agitating roller 706, the opening 704*a* being sealed with a window member 707 made of a transparent material such as glass or resin. A reflective photo sensor 708 can emit and receive light. The reflective photo sensor 708 is arranged in order that the incident light and the reflected light can be obtained with respect to the surface of the agitating roller 706 through the window member 707.

The liquid toner is agitated inside the casing 704 by means of the agitating screw 705 and the agitating roller 706, and the liquid toner is led towards the window member 707 by the rotating of the agitating roller 706. At this point, the reflected light of the reflective photo sensor is detected, providing information on the solid particle concentration in the liquid toner in a control circuit 709 by a method to be described later (described in FIGS. 11, 12 and 13).

In accordance with the concentration information obtained, the concentration of the liquid toner inside the casing 704 is maintained at a substantially fixed level by supplying an appropriate amount of concentrated toner or carrier liquid, via valves 713 and 711, from either a concentrated toner tank 710, which stores concentrated toner with a higher concentration of solid particles than liquid toner, or from a carrier liquid tank 712, which stores a compound of liquid solvent and dispersing agent.

The configuration of this embodiment is such that an appropriate amount of concentrated toner or carrier liquid is supplied by gravity from either the concentrated toner tank 710 or from the carrier liquid tank 712 via the valves 711 and 713. Either valve 711 or 713 can, however, be replaced with a pump such as a tube pump, a diaphragm pump or a gear pump.

As described above, the configuration of the invention is such that the liquid toner is forced between the outer periphery of the agitating roller 706 and the inner surface of the window member 707, and the concentration of the liquid toner is detected by the reflective photo sensor 708 arranged outside the window member 707. As such, even if the image forming apparatus is tilted when installing or moving the image forming apparatus, or the image forming apparatus is subjected to vibration then, as described in JP-A-2001-356608, there is no possibility of losing the required detection accuracy due to liquid toner adhering to the reflective photo sensor itself, or to the detecting window arranged in the front of the sensor. Furthermore, as the outer periphery of the agitating roller 706 and the inner surfaces of the casing 704 and the window member 707 have different curvatures and are disposed in close proximity to each other, the pressure of the liquid toner increases in the area in which the outer periphery of the agitating roller 706 and the inner surfaces of the casing 704 and the window member 707 are in closest proximity while the agitating roller 706 is rotating.

Owing to the aforementioned pressure, the inner peripheral surface of the window member 707 is refreshed. For example, even in the event that the image forming apparatus is not used for a long period, or the liquid toner inside the casing 704 dries up, it is easily possible to restore the situation where the toner concentration can be detected. Furthermore, even in the event that the amount of liquid toner falls off below a predetermined amount, the detecting function can easily be restored after replenishing the liquid toner, and accurate detecting can be restarted.

Furthermore, the configuration of the liquid toner concentration detecting device of this embodiment is such that the agitating and mixing for reusing the toner and the concentration detection of the liquid toner can be carried out within one device, enabling the whole image forming apparatus to be made more compact.

Figure 4:
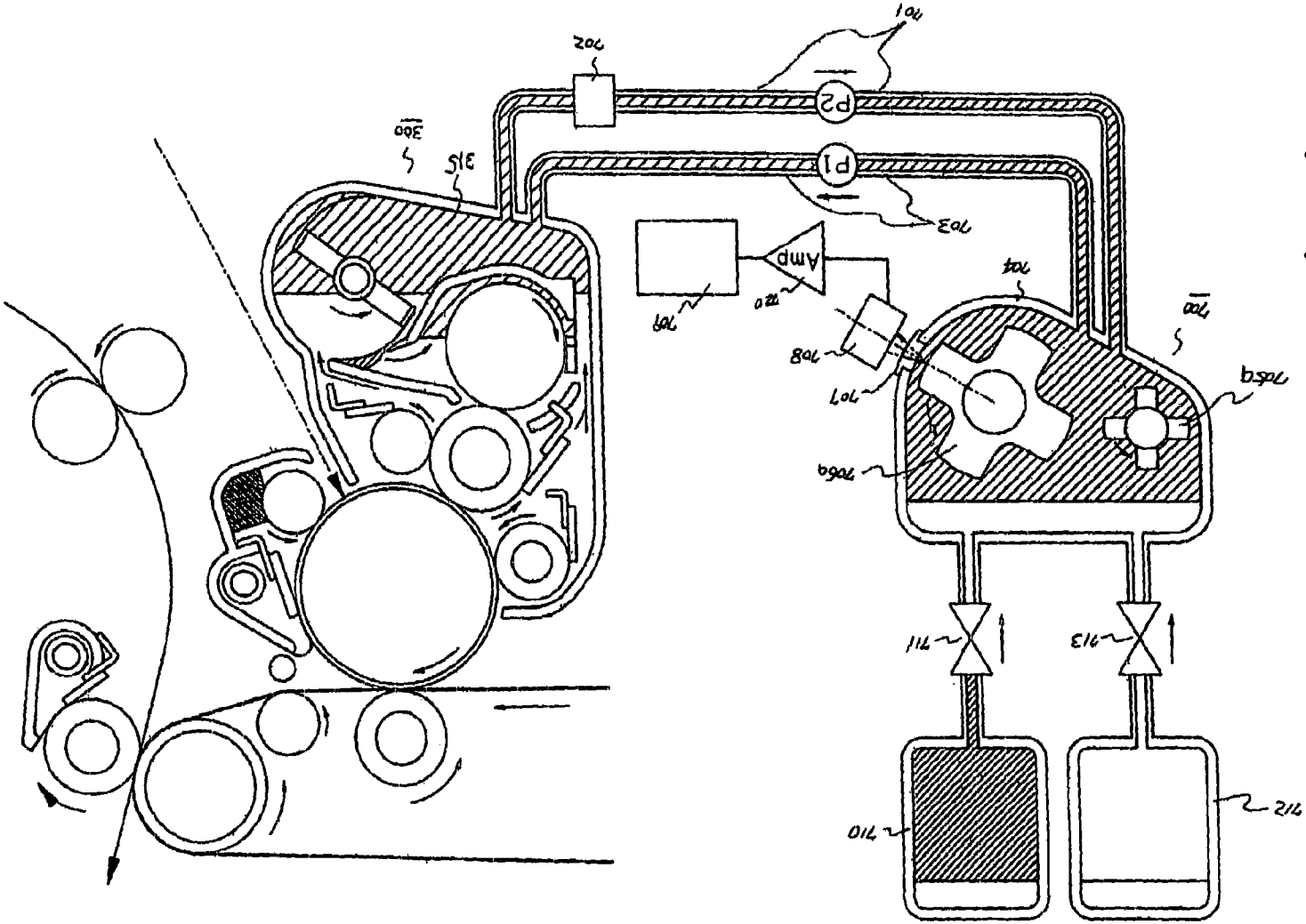
FIG. 4 is a view showing embodiment 2 of the liquid toner concentration detecting device of the invention.

FIG. 4 is a sectional view showing embodiment 2 of the liquid toner concentration detecting device of the invention. As the main configuration and operations of this embodiment are the same as the previously described embodiment 1, those descriptions will be omitted.

As the components which are different from embodiment 1, an agitating blade 705*a* and an agitating roller 706*a* are included in the liquid toner agitating member inside the casing 704. When the agitating blade 705*a* and the agitating roller 706*a* rotate, the raised and depressed shapes on the outer peripheries of the two components face each other, providing a higher performance of liquid toner agitating than that of embodiment 1.

Furthermore, as the agitating roller 706*a*, which has the raised and depressed portions, rotates facing the window member 707, the pressure fluctuation of the liquid toner at the point where the two components are in close proximity is greater than in the case of embodiment 1, providing easier refreshing of the inner peripheral surface of the window member 707.

Figure 5A:
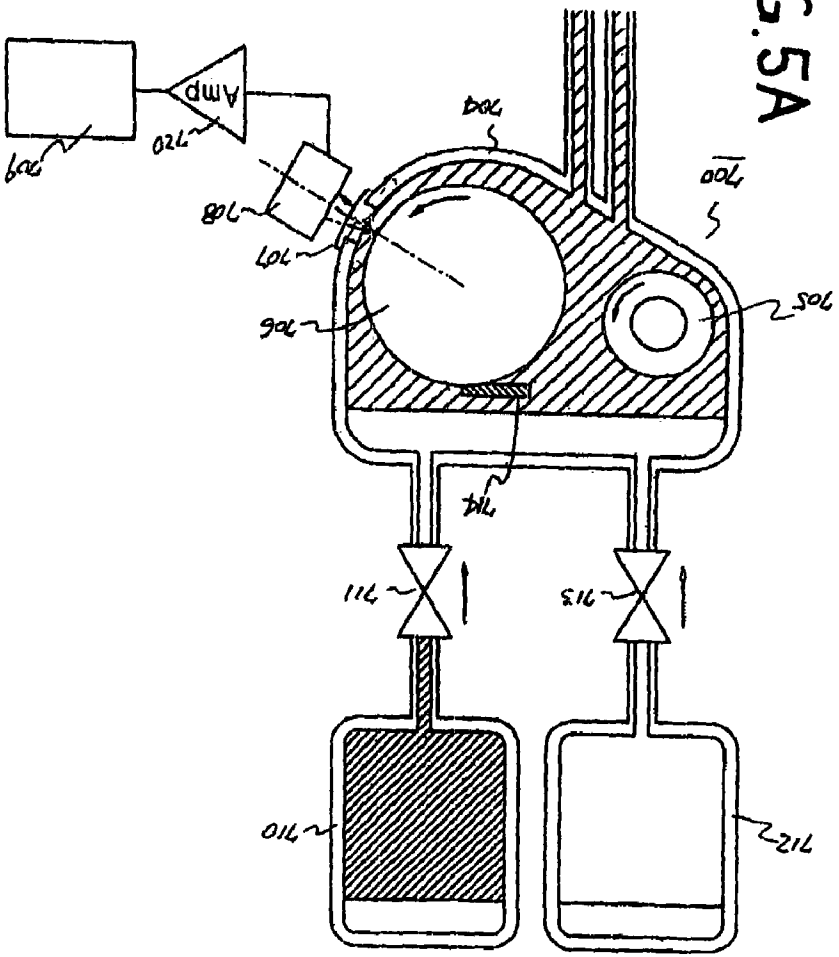
FIGS. 5A and 5B are views showing embodiments 3 and 4 of the liquid toner concentration detecting device of the invention.
Figure 5B:
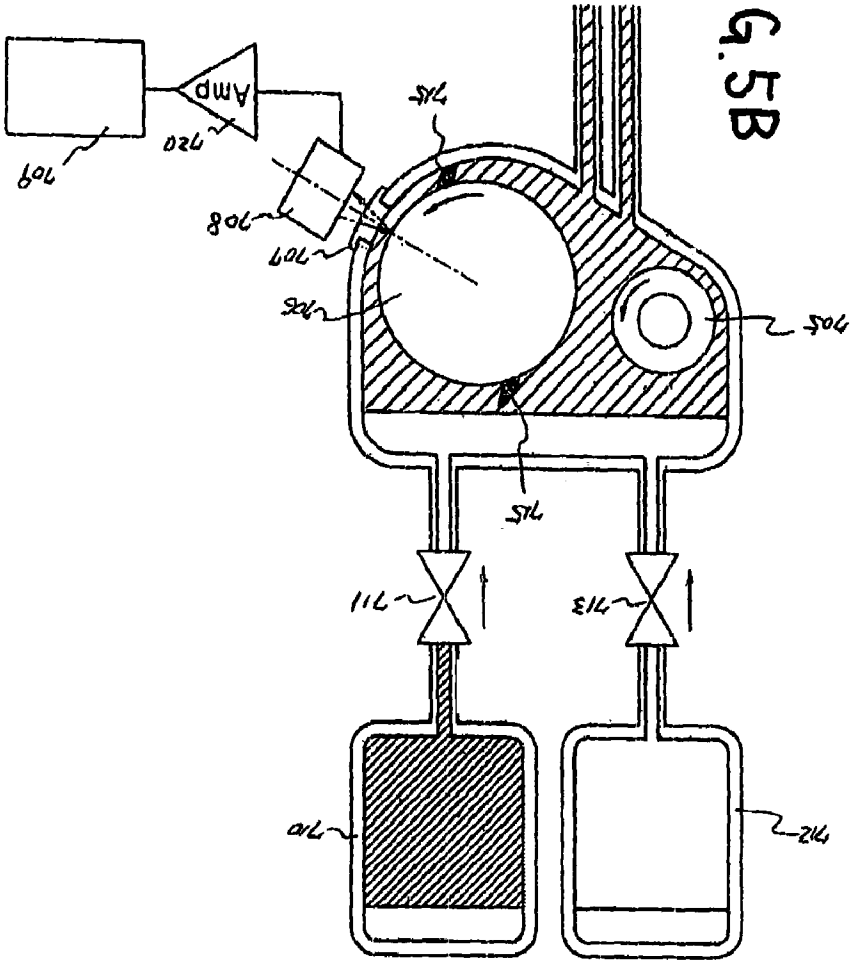

FIGS. 5A and 5B are sectional views showing embodiments 3 and 4 of the liquid toner concentration detecting device of the invention. As the main configuration and operations of these embodiments are the same as the previously described embodiment 1, those descriptions will be omitted.

In FIG. 5A, as the component which is different from embodiment 1, there is provided an agitating roller blade 714 which comes into contact with the agitating roller 706. The agitating roller blade 714 is preferably made of a flexible metal plate such as urethane rubber, stainless steel or phosphor bronze and, as it comes into contact with the agitating roller 706*a*, it has the function of cleaning the surface of the agitating roller 706*a*. Owing to this cleaning function, it is possible to obtain a stable output signal from the reflective photo sensor 708, even when using a liquid toner with a high concentration of solid particles.

In FIG. 5B, as the component which is different from embodiment 1, there is provided a refresh blade 715 attached to the outer periphery of the agitating roller 706. The refresh blade 715 is preferably made of a soft material such as urethane rubber or polyethylene resin and, as it is brought into sliding contact with the window member 707 by the rotating of the agitating roller 706*a*, it has the function of cleaning the inner surface of the window member 707. Owing to this cleaning function, the inner surface of the window member 707 is constantly refreshed, even when using a liquid toner with a high concentration of solid particles, making it possible to obtain a stable output signal from the reflective photo sensor 708.

Figure 6:
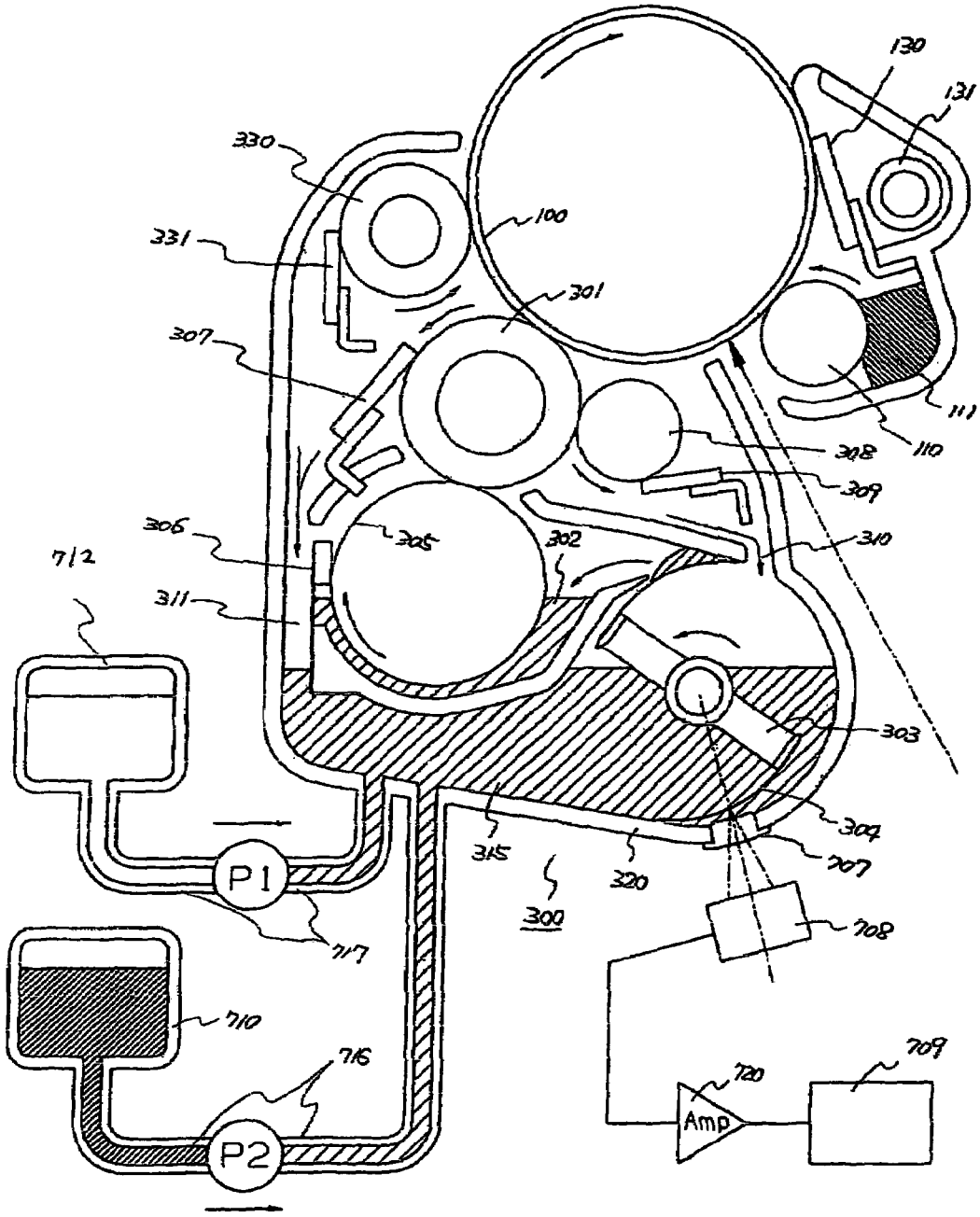
FIG. 6 is a view showing embodiment 5 of the liquid toner concentration detecting device of the invention.

FIG. 6 is a sectional view showing embodiment 5 of the liquid toner concentration detecting device of the invention. The feature of this embodiment is that the liquid toner concentration detecting device is built into the developing device described in FIG. 2.

According to this embodiment, the window member 707 is provided in the container 320 of the developing device 300 shown in FIG. 2, and the plate-shaped agitating member 304 rotating with the agitator 303 is made to face the reflective photo sensor 708 via the window member 707. The signal, received from the reflective photo sensor 708 through the liquid toner forced between the plate-shaped agitating member 304 and the inner surface of the window member 707, is detected by a method of detecting a liquid toner to be described later (FIGS. 12, 14, etc.), thus obtaining information on the liquid toner solid particle concentration.

The plate-shaped agitating member 304 can be configured of a metal plate made of stainless steel, phosphor bronze or the like, or a resin plate made of polyethylene terephthalate or the like. However, in the event that the plate-shaped agitating member 304 is configured of a resin plate made of polyethylene terephthalate or the like, it is preferable that the surface thereof is subjected to a treatment such as aluminum evaporation and thus provided with a high degree of light reflectivity. In accordance with the concentration information obtained, the concentration of the liquid toner inside the primary reservoir 315 is maintained at a substantially fixed level by supplying an appropriate amount of concentrated toner or carrier liquid, via a concentrated toner supply path 716 or a carrier liquid supply path 717, by means of the pumps P1 and P2, from either the concentrated toner tank 710, which stores concentrated toner with a higher concentration of solid particles than liquid toner, or from the carrier liquid tank 712, which stores a compound of liquid solvent and dispersing agent.

The configuration of this embodiment is such that the concentrated toner or carrier liquid is conveyed by the pumps P1 and P2. However, in the event that the concentrated toner tank 710 or the carrier liquid tank 712 can be located at a level different from that of the liquid toner in the primary reservoir 315 of the developing device 300, it is possible to replace the pumps P1 and P2 with a valve. Furthermore, tube pumps, diaphragm pumps, gear pumps; or the like can be used for the pumps P1 and P2.

With such a configuration, the rotating of the agitator 303 brings the plate-shaped agitating member 304 into sliding contact with the window member 307, thus cleaning the inner surface of the window member 707. The cleaning effect can be more reliably obtained by causing the inner surface of the window member 707 to protrude slightly into the primary reservoir 315.

Owing to this cleaning function, the inner surface of the window member 707 is constantly refreshed, even when using a liquid toner with a high concentration of solid particles, making it possible to obtain a stable output signal from the reflective photo sensor 708.

Furthermore, as the liquid toner concentration detecting device is built into the developing device 300 described in FIG. 2, the concentration detection of the liquid toner and the agitating and mixing for reusing the liquid toner can be carried out within the developing device 300, enabling the whole image forming apparatus to be made more compact.

Figure 7:
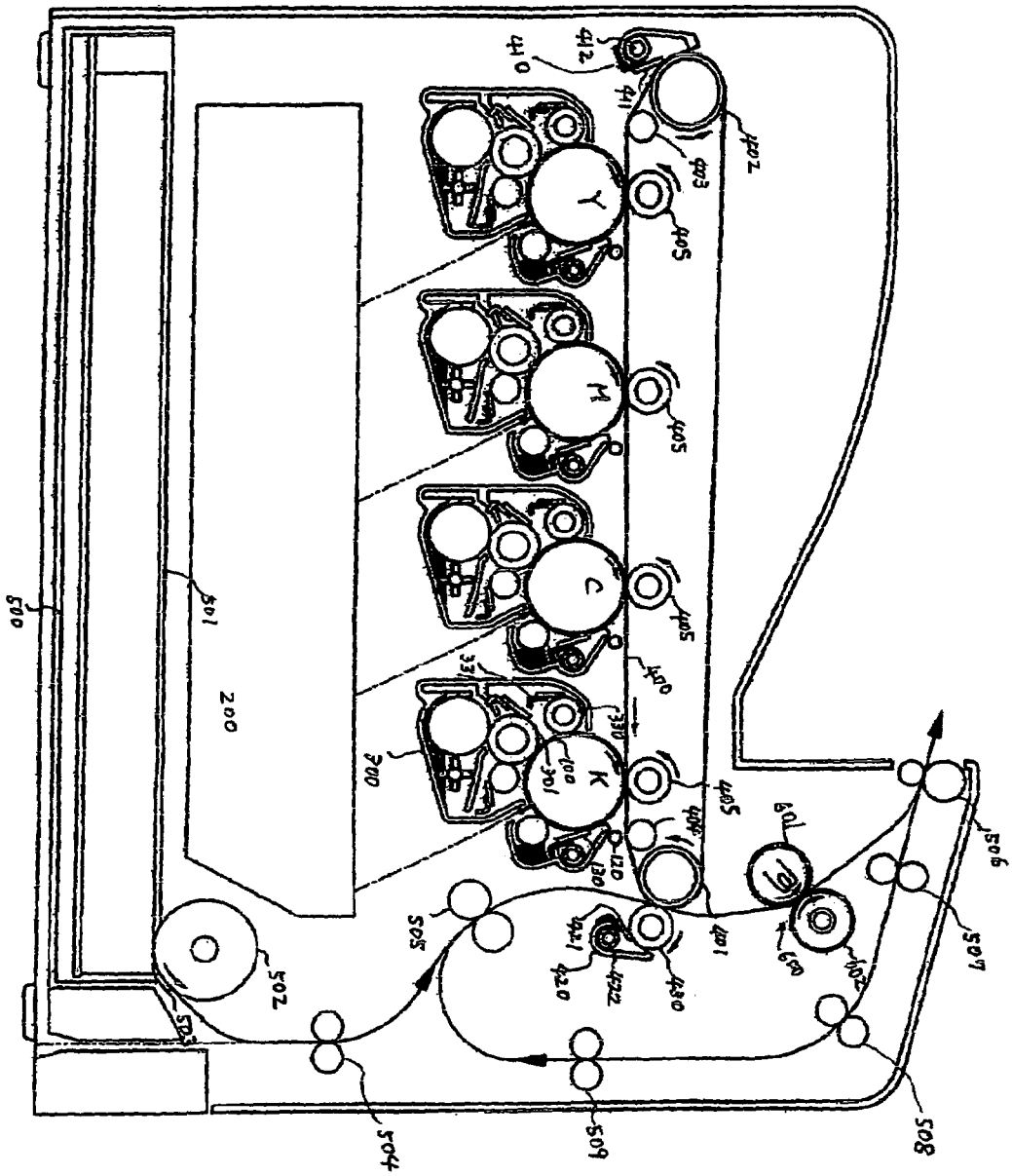
FIG. 7 is a view showing the overall configuration of embodiment 6 of the invention.
Figure 8:
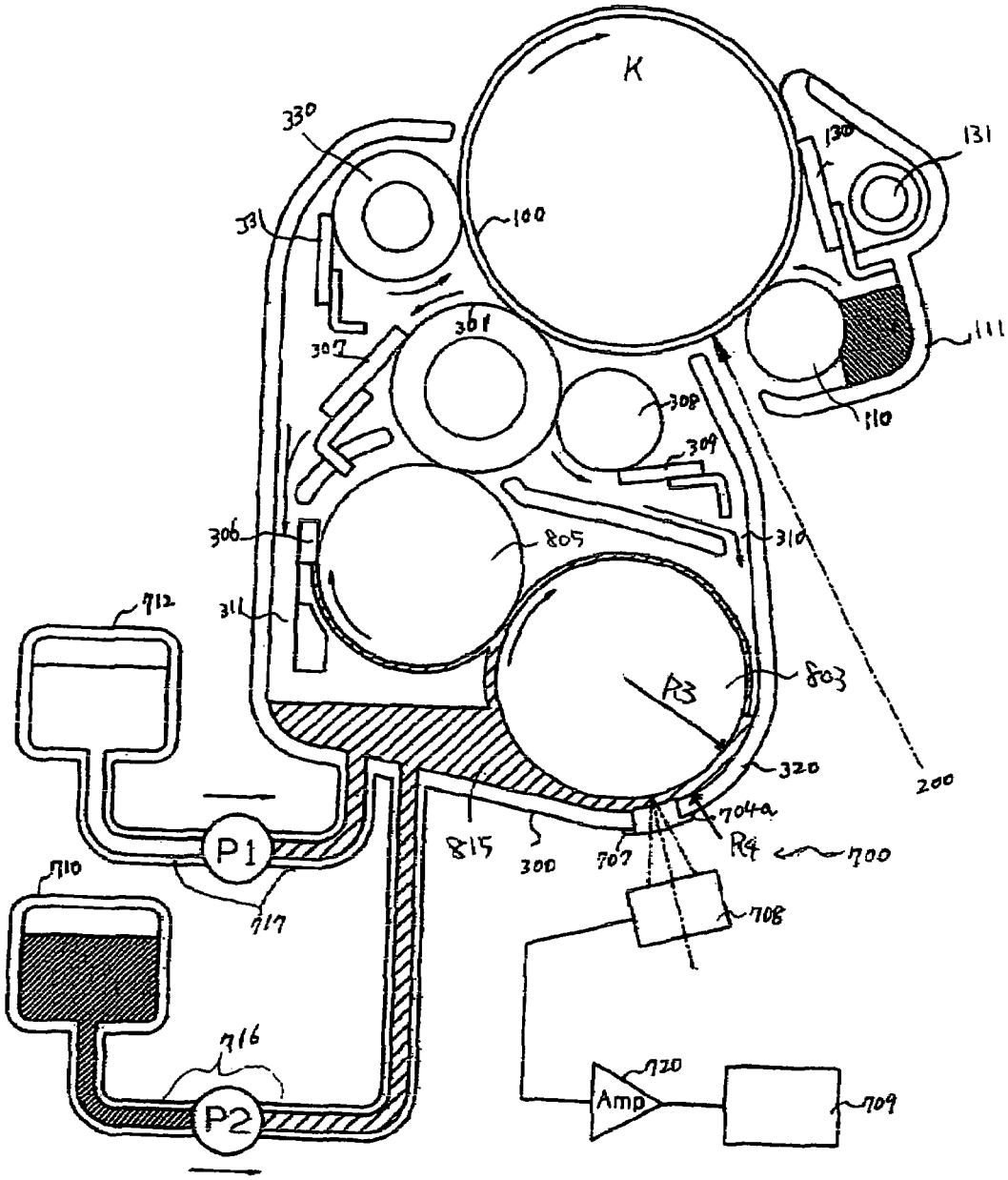
FIG. 8 is a partial enlarged view of embodiment 6 of a black image forming section in FIG. 7.

FIG. 8 is a partial enlarged view of embodiment 6 of the black image forming section K of the image forming apparatus shown in FIG. 7. The configuration of embodiment 6 of a liquid developing device and liquid toner concentration detecting device of the image forming apparatus of the invention will be described with reference to FIG. 8. As the main configuration and operations of this embodiment are the same as the previously described embodiment 1, those descriptions will be omitted.

The liquid developing device 300 includes a liquid toner reservoir 815 in the lower part of the container 320. When using liquid toner of a high viscosity, it is effective to install a rotating lifting roller 803 in the liquid toner reservoir 815 in order to supply liquid toner to an Anilox roller 805.

The lifting roller 803 is made of a material such as metal or resin, is disposed near or in contact with the Anilox roller 805, agitates the liquid toner by rotating inside the liquid toner reservoir 815, and at the same time supplies liquid toner to the Anilox roller by affixing a thick layer of high viscosity liquid toner to the surface of the Anilox roller.

The Anilox roller 805 has on its surface microscopic grooves such as spiral grooves. The toner regulating blade 306, which includes the flexible metal plate with urethane rubber on its tip in contact with the Anilox roller 805, scratches off and collects the liquid toner into the grooves on the surface of the Anilox roller 805.

The liquid toner accommodated inside the grooves on the surface of the Anilox roller 805 is transferred to the surface of the developing roller 301 by being brought into contact with the developing roller 301, which has a metal shaft covered with an elastic material such as conductive urethane rubber. The leveling roller 308, which rotates in contact with the developing roller 301 and is impressed with a bias of a polarity equivalent to that of the liquid toner and higher than that of the developing roller 301 by a power source (not shown), obliterates the groove pattern on the Anilox roller 805 surface, and creates a uniform film of liquid toner.

The liquid toner returned to the liquid toner reservoir 815 via the collecting opening 310 and the collecting pathway 311 is agitated by the rotation of the lifting roller 803, affixed again to the lifting roller 803, and supplied to the Anilox roller 805.

The liquid toner reservoir 815 of the liquid developing device 300 is communicated with the concentrated toner tank 710 by the supply path 716 and the pump P2, and with the carrier liquid tank 712 by the supply path 717 and the pump P1.

The liquid toner concentration detecting device 700 is disposed below the liquid toner reservoir 815 of the liquid developing device 300. The lifting roller 803 disposed in the liquid toner reservoir 815 is operable to reflect the light. The outer periphery of the lifting roller 803 and the inner surface of the outer wall of the liquid toner reservoir 815 have different curvatures R3 and R4, and they are preferably set so that the distance between the two is preferably 0.5 mm or less or, in the case of a liquid toner of high concentration, 0.1 mm or less.

The outer wall of the liquid toner reservoir 815 is provided with the opening 704*a* at the point at which the outer periphery of the lifting roller 803 comes in closest proximity with the inner surface of the outer wall of the liquid toner reservoir 815, the opening 704*a* being sealed with the window member 707. A reflective photo sensor 708 can emit and receive light. The reflective photo sensor 708 is arranged in order that the incident light and the reflected light can be obtained with respect to the surface of the lifting roller 803 through the window member 707.

In accordance with the concentration information obtained, the concentration of the liquid toner inside the liquid toner reservoir 704 is maintained at a substantially fixed level by supplying an appropriate amount of concentrated toner or carrier liquid from either the concentrated toner tank 710, which stores concentrated toner with a higher concentration of solid particles than the liquid toner inside the liquid toner reservoir 815 of the liquid developing device 300, or from the carrier liquid tank 712, which stores a compound of liquid solvent and dispersing agent, via the pump P2, installed in the concentrated toner supply path 716, or the pump P1, installed in the carrier liquid supply path 717.

As described above, the configuration of this embodiment is such that the liquid toner is forced between the outer periphry of the lifting roller 706 and the inner surface of the window member 707, and the concentration of the liquid toner is detected by the reflective photo sensor 708 arranged outside the window member 707. As such, even if the image forming apparatus is tilted when installed or moved, or is subjected to vibration then, as described in JP-A-2001-356608, there is no possibility of losing the required detection accuracy due to liquid toner adhering to the reflective photo sensor itself, or to the window disposed in the front of the sensor. Furthermore, as the outer periphery of the lifting roller 803 and the inner surfaces of the outer wall of the liquid toner reservoir 815 and the window member 707 have different curvatures and are disposed in close proximity to each other, the pressure of the liquid toner increases in the area in which the outer periphery of the outer wall of the lifting roller 803 and the inner surfaces of the outer wall of the liquid toner reservoir 815 and the window member 707 are in closest proximity while the lifting roller 803 is rotating.

Owing to the aforementioned pressure, the inner peripheral surface of the window member 707 is refreshed. For example, even in the event that the image forming apparatus is not used for a long period, or the liquid toner inside the liquid toner reservoir 815 dries up, it is easily possible to restore the situation where the toner concentration can be detected. Furthermore, even in the event that the amount of liquid toner falls off below a predetermined amount, the detecting function can easily be restored after replenishing the liquid toner, and accurate detecting can be restarted.

Figure 9:
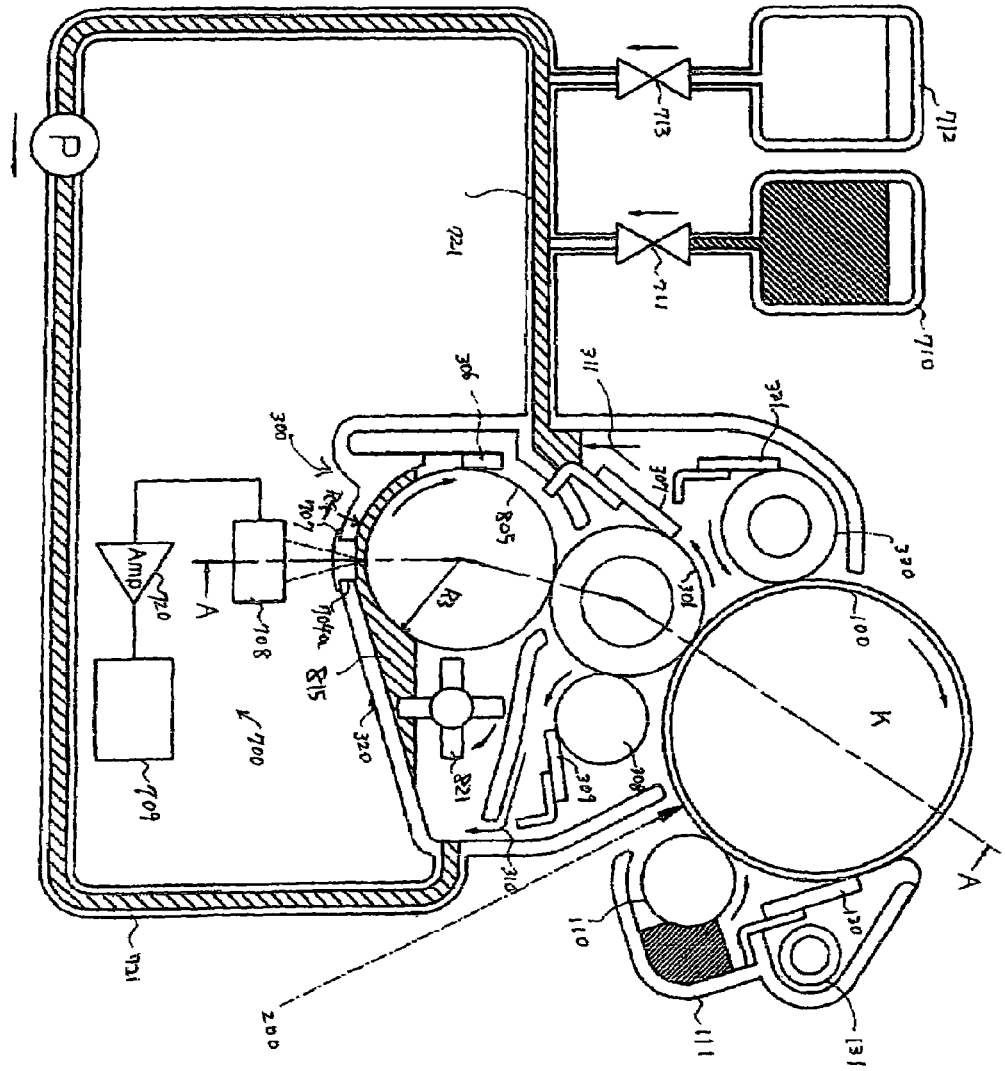
FIG. 9 is a partial enlarged view of embodiment 7 of a black image forming section in FIG. 7.

FIG. 9 is a sectional view showing embodiment 7 of the liquid developing device 300 and the liquid toner concentration detecting device 700 of the invention. As the main configuration and operations of this embodiment are the same as the previously described embodiment 6, only the configuration which differs from embodiment 6 will be described.

The liquid toner reservoir 815 is arranged at the lower part of the container 320, and the Anilox roller 805 and an agitator 821 are disposed inside the liquid toner reservoir 815. This configuration is effective when the liquid toner has a low viscosity.

The Anilox roller 805 has on its surface microscopic grooves such as spiral grooves. In the case of this embodiment, however, that part of the Anilox roller 805 disposed in the reservoir which is not formed with microscopic grooves is operable to reflect the light. The part of the Anilox roller 805 not having microscopic grooves is formed, as a flat, smooth portion, on part of the outer periphery of the Anilox roller 805.

Furthermore, one difference in configuration from embodiment 6 is that the liquid toner scratched off by the roller blade 307 in contact with the surface of the developing roller 301, as well as the liquid solvent scratched off by the roller cleaner 331 in contact with the squeezing roller 330, which comes into contact with the photo receptor 100 thus taking off excess liquid solvent, drops by gravity through the collecting pathway 311, and is collected in the liquid toner supply path 721.

The liquid toner supply path 721 is communicated with the liquid toner reservoir 815 of the liquid developing device 300 by means of a pump P. Furthermore, the liquid toner supply path 721 is communicated with the concentrated toner tank 710 and with the carrier liquid tank 712 by means of valves 711 and 713 respectively.

The liquid toner concentration detecting device 700 is arranged below the liquid toner reservoir 815 of the liquid developing device 300. The part of the Anilox roller 805, disposed in the liquid toner reservoir 815, not having microscopic grooves (A flat, smooth surface formed at an end of the Anilox roller 805 inside the liquid toner reservoir 815 opposite a gear drive section) is operable to reflect the light. The outer periphery of the Anilox roller 805 and the inner surface of the outer wall of the liquid toner reservoir 815 have different curvatures R3 and R4, and they are preferably set so that the distance between the outer periphery of the part of the Anilox roller 805 not having microscopic grooves and the inner wall of the container 320 of the reservoir is preferably 0.5 mm or less or, in the case of a liquid toner of high concentration, 0.1 mm or less. As the outer periphery of the Anilox roller 805 and the inner surfaces of the outer wall of the liquid toner reservoir 815 and the window member 707 have different curvatures and are disposed in close proximity to each other, the pressure of the liquid toner increases in the area in which the outer periphery of the Anilox roller 805 and the inner surfaces of the outer wall of the liquid toner reservoir 815 and the window member 707 are in closest proximity while the Anilox roller 805 is rotating. Owing to the aforementioned pressure, the inner peripheral surface of the window member 707 is refreshed. For example, even in the event that the image forming apparatus is not used for a long period, or the liquid toner inside the liquid toner reservoir 815 dries up, it is easily possible to restore the situation where the toner concentration can be detected. Furthermore, even in the event that the amount of liquid toner falls off below a predetermined amount, the detecting function can easily be restored after replenishing the liquid toner, and accurate detecting can be restarted.

The liquid storage toner tank 815 is provided with the opening 704*a* at the point at which the outer periphery of the part of the Anilox roller 805 not having microscopic grooves comes in closest proximity with the inner surface of the outer wall of the liquid storage toner tank 815, the opening 704*a* being sealed with the window member 707 made of a transparent material such as glass or resin. The reflective photo sensor 708 is arranged in order that the incident light and the reflected light can be obtained between the window material and the surface of the lifting roller 803 via the window member 707.

In accordance with the concentration information obtained, the concentration of the liquid toner inside the liquid toner reservoir 815 is maintained at a substantially fixed level by supplying an appropriate amount of concentrated toner or carrier liquid from either the concentrated toner tank 710, which stores concentrated toner with a higher concentration of solid particles than the liquid toner inside the liquid toner reservoir 815 of the liquid developing device 300, or from the carrier liquid tank 712, which stores a compound of liquid solvent and dispersing agent, through the toner supply path 721 via the valve 711 or 713.

Figure 10:
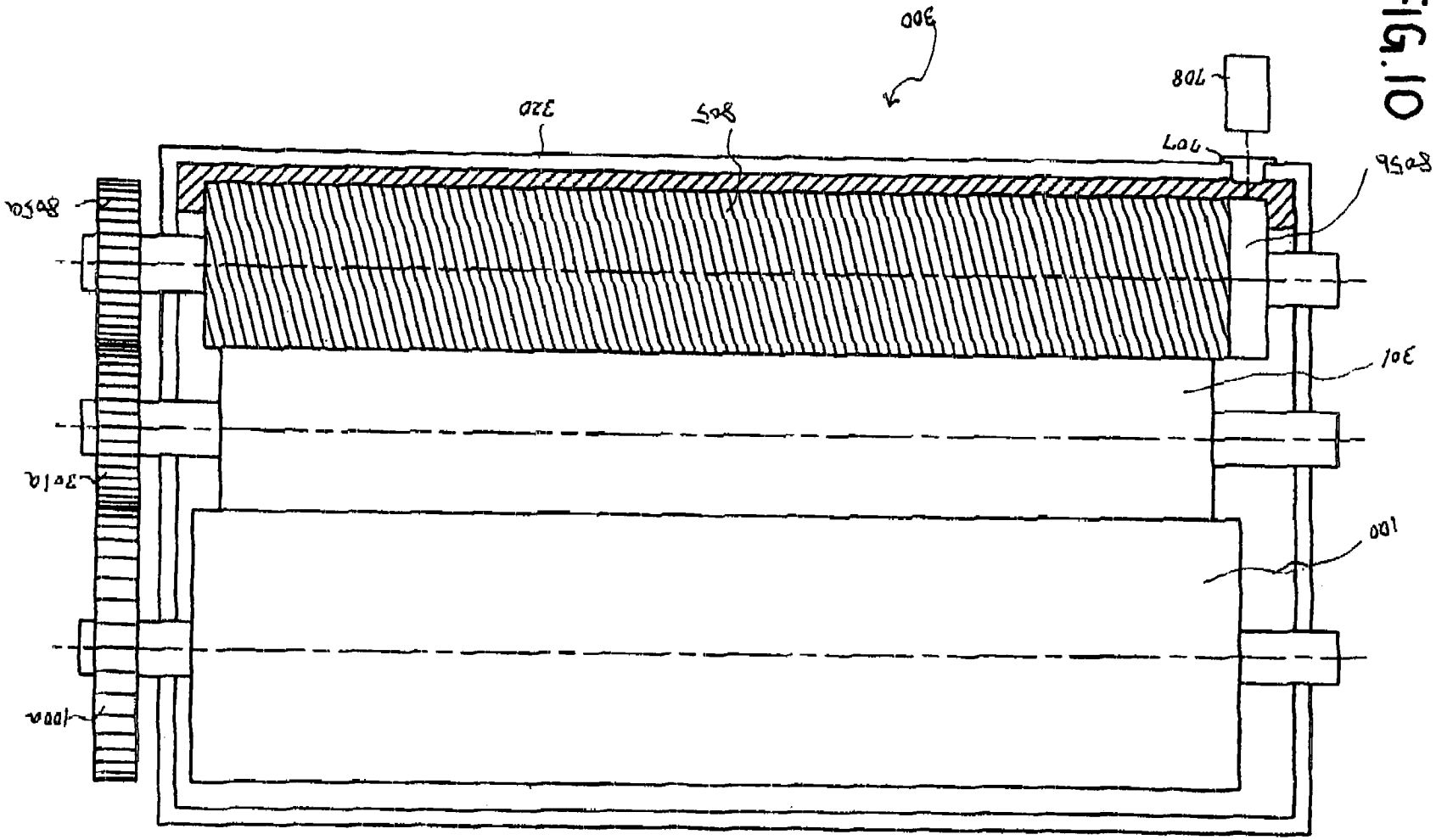
FIG. 10 is a sectional view taken along the A-A line of FIG. 9.

FIG. 10 is a sectional view taken along the A-A line of FIG. 9. The Anilox roller 805, the developing roller 301 and the photo receptor 100 are arranged in the liquid developing device 300. One-end portions of the Anilox roller 805, the developing roller 301 and the photoreceptor 100 is provided with an Anilox roller gear 805*a*, a developing roller gear 301*a* and a photoreceptor gear 100*a*, respectively. The axial length of the Anilox roller 805 is greater than that of the developing roller 301, while the axial length of the part of the Anilox roller 805, formed with microscopic grooves, covers the entire axial length of the developing roller 301. The flat, smooth part 805*b* which has no microscopic grooves is formed at the end of the Anilox roller 805 opposite to that of the Anilox roller gear 805*a*. The flat, smooth part 805*b* is formed in a position which does not come into contact with the developing roller 301. This flat, smooth part 805*b* is operable to reflect the light. The transparent window 707 is disposed in the wall of the liquid toner reservoir 815 which corresponds to the flat, smooth part 805*b* of the Anilox roller 805, and the reflective photo sensor 708 is arranged below the window 707. As the photo sensor can be arranged on the side opposite to that of the gear, it is possible to prevent detecting errors and noise caused by detecting interval fluctuation due to the slight vibration of the gear drive.

The configuration of this embodiment is such that the liquid toner is forced between the outer periphery of the part of the Anilox roller 805 not having microscopic grooves and the inner surface of the window member 707, and the concentration of the liquid toner is detected by the reflective photo sensor 708 arranged outside the window member 707. As such, even if the image forming apparatus is tilted when installed or moved, or is subjected to vibration then, as described in JP-A-2001-356608, there is no possibility of losing the desired detection accuracy due to liquid toner adhering to the reflective photo sensor itself, or to the window disposed in the front of the sensor.

Figure 11:
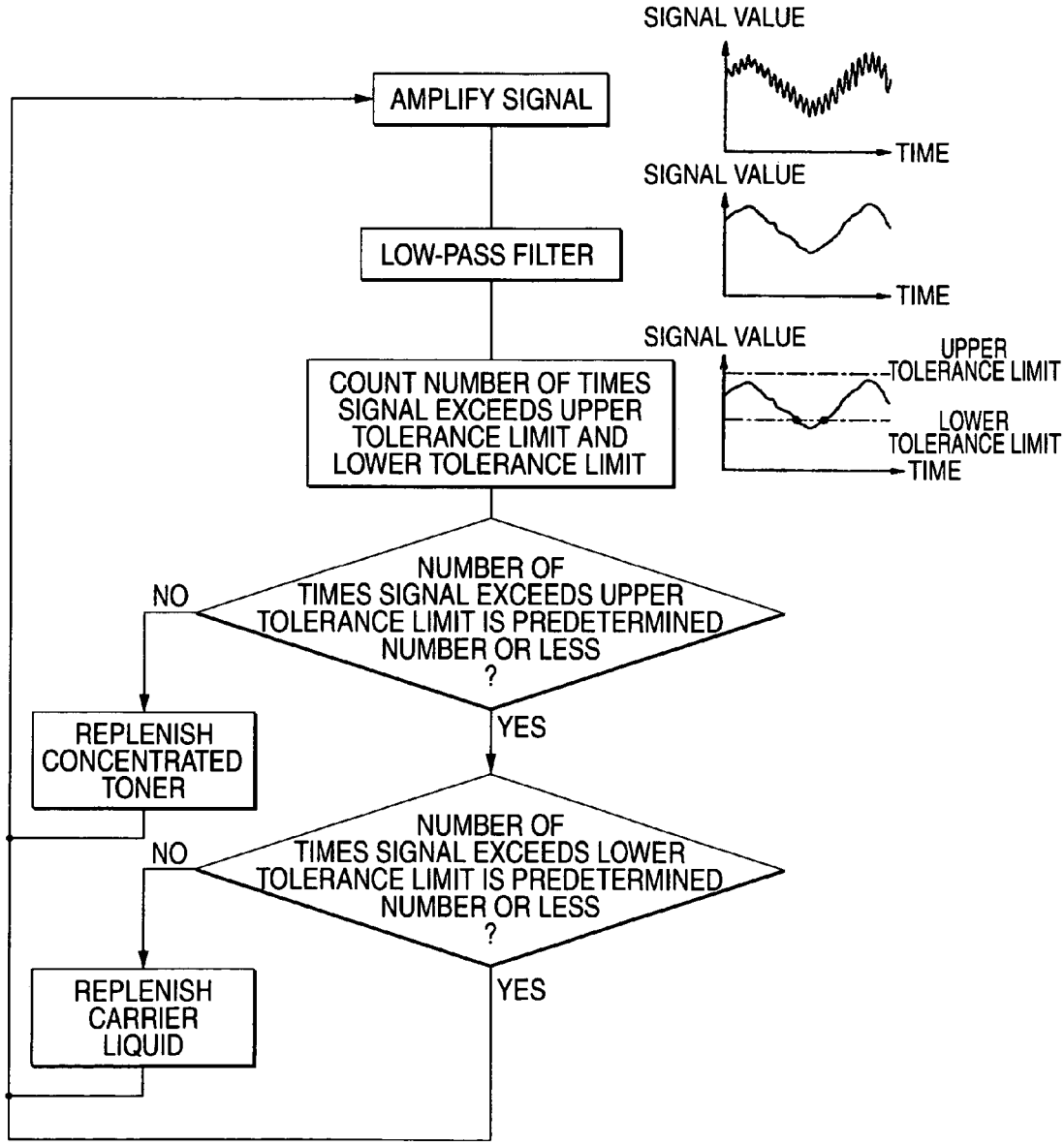
FIG. 11 is a flowchart illustrating a method of controlling a concentration of the liquid toner (part 1) for the liquid toner concentration detecting device shown in FIG. 3.

FIG. 11 is a flowchart illustrating a method of controlling a concentration of the liquid toner (part 1) for the liquid toner concentration detecting device shown in FIG. 3. This embodiment will be a description of the configuration in which the lower the concentration of the liquid toner, the greater will be the amount of reflected light returning to the reflective photo sensor 708, and the larger the signal which can be obtained from the reflective photo sensor 708.

The signal obtained from the reflective photo sensor 708 shown in FIG. 3 is amplified by an amplifying circuit 720 provided in the reflective photo sensor 708 or in the control circuit 709, and the high frequency component in the signal is removed by a low-pass filter.

Next, the number of times a signal value (a value of the signal) exceeds a pre-set upper tolerance limit and lower tolerance limit within a predetermined time is counted. In the event that the signal value exceeds the upper tolerance limit more than a predetermined number of times, the concentration of the liquid toner will be determined to have decreased. Thus, the valve 711 shown in FIG. 3 is released for a predetermined time, concentrated toner is supplied to the casing 704 from the concentrated toner tank 710, and the signal amplification process, low-pass filter process, and the counting of the number of times the upper tolerance limit and lower tolerance limit are exceeded, are repeated.

If the number of times the signal value exceeds the upper tolerance limit is less than the predetermined number of times, it is then determined whether the number of times the signal value exceeds the lower tolerance limit is less than the predetermined number of times.

In the event that the signal value exceeds the lower tolerance limit more than the predetermined number of times, the concentration of the liquid toner will be determined to have increased. Thus, the valve 713 shown in FIG. 3 is released for a predetermined time, carrier liquid is supplied to the casing 704 from the carrier liquid tank 712, and the signal amplification process, low-pass filter process, and the counting of the number of times the upper tolerance limit and lower tolerance limit are exceeded, are repeated.

If either of the aforementioned evaluations shows that the number of times is less than the predetermined number of times, the signal amplification process, low-pass filter process and the counting of the number of times the signal value exceeds the upper tolerance limit and lower tolerance limit are repeated.

The carrier liquid or concentrated toner supplied in accordance with the aforementioned controls is mixed with the liquid toner inside the casing 704 by means of the agitating screw 705 and the agitating roller 706, and by repeating the aforementioned controls, the concentration of the liquid toner inside the casing 704 is maintained within a predetermined range.

The method of controlling the concentration of this embodiment can also be applied to the liquid toner concentration detecting device described in FIGS. 4, 5B, 6, 8 and 9. In this case, however, the aforementioned control need be exerted in synchronization with the rotating frequency of the agitating roller 706*a* shown in FIG. 4, the agitating roller 706 shown in FIG. 5B, the agitator 303 shown in FIG. 6, the lifting roller 803 shown in FIG. 8 and the Anilox roller 805 shown in FIG. 9, and thus in a timed relationship capable of obtaining reflected light.

With such a configuration, liquid toner concentration control is possible using a simple circuit and software configuration.

Figure 12:
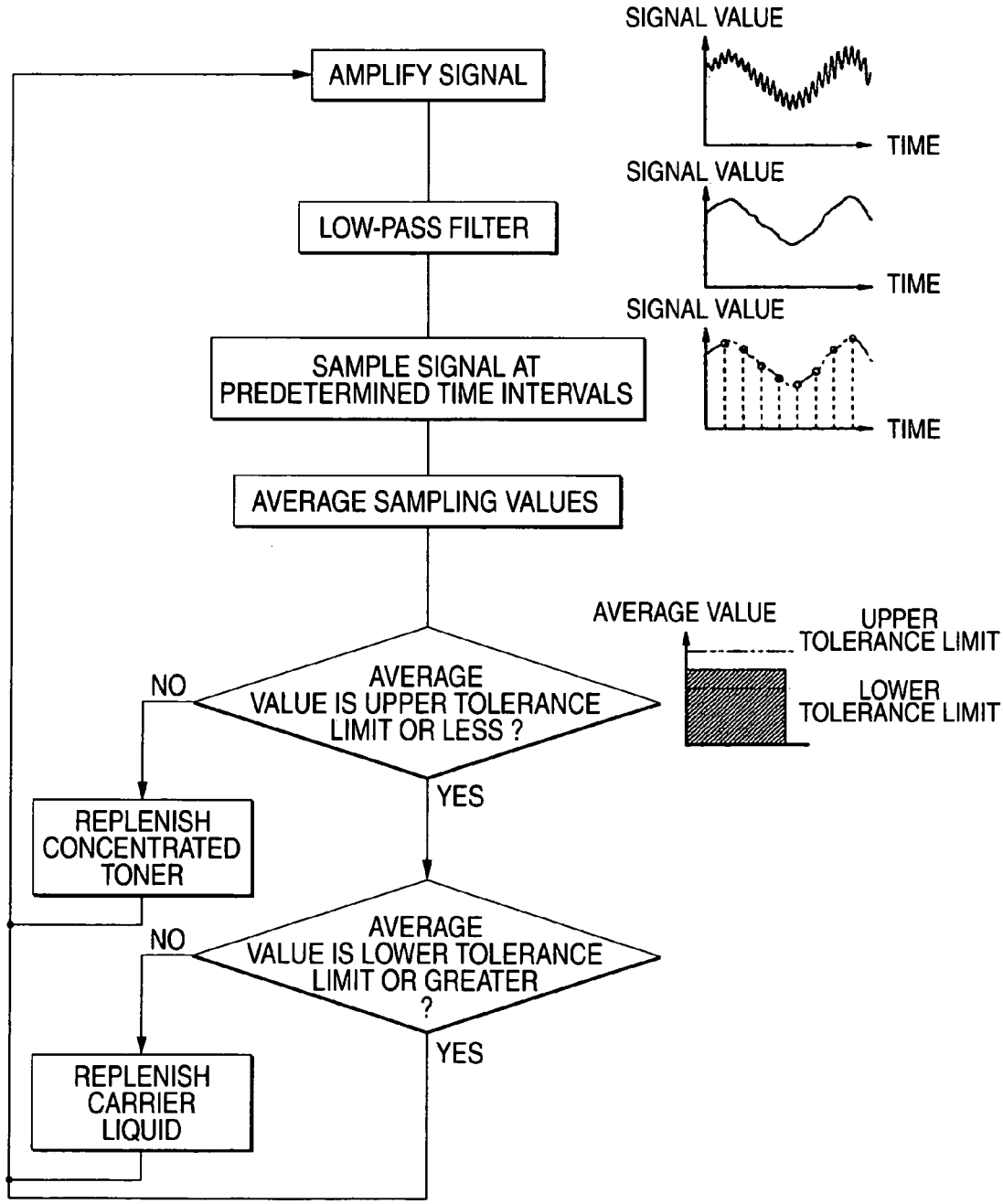
FIG. 12 is a flowchart illustrating a method of controlling a concentration of the liquid toner (part 2) for the liquid toner concentration detecting device shown in FIG. 3.
Figure 13:
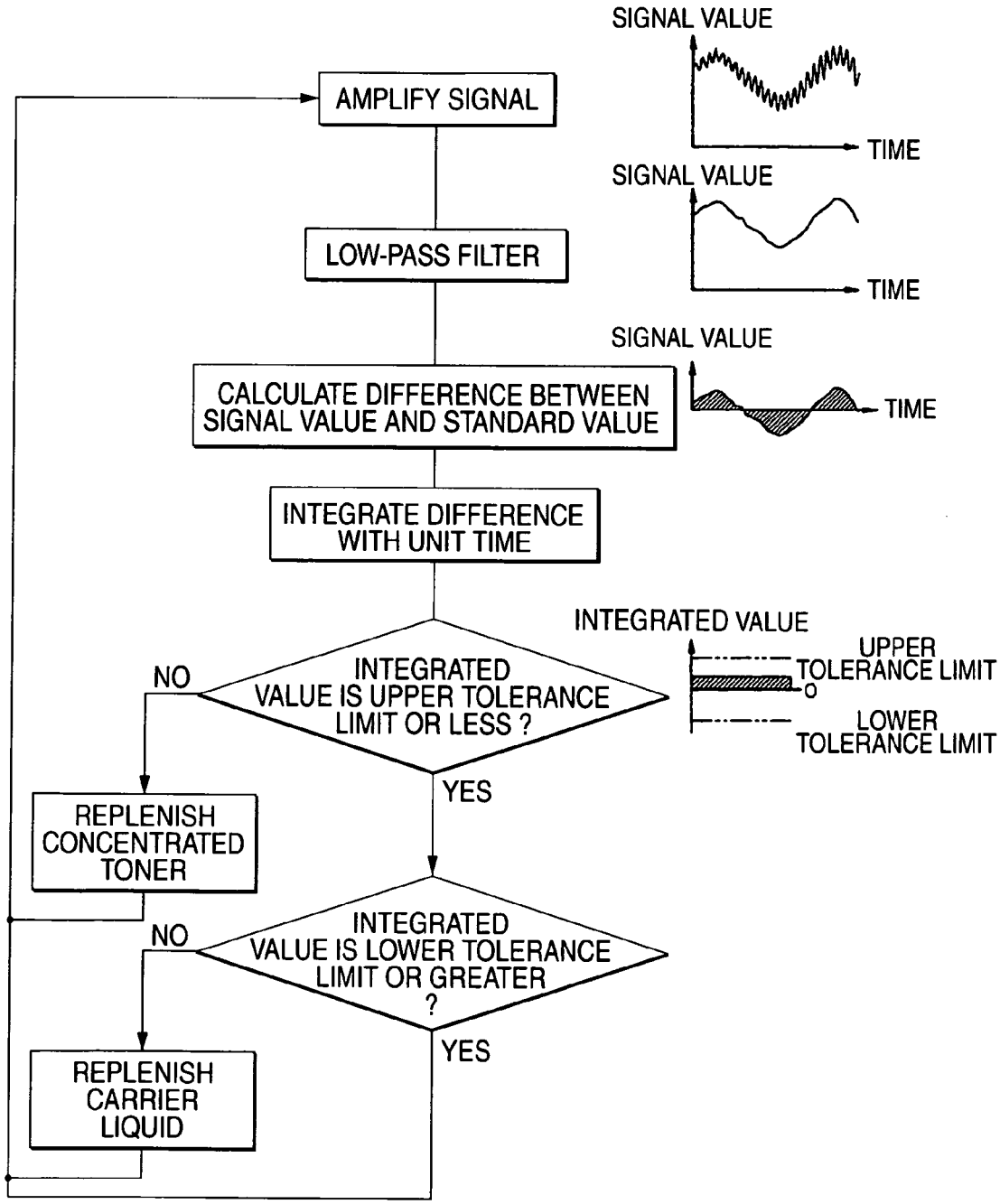
FIG. 13 is a flowchart illustrating a method of controlling a concentration of the liquid toner (part 3) for the liquid toner concentration detecting device shown in FIG. 3.

FIG. 12 is a flowchart illustrating a method of controlling a concentration of the liquid toner (part 2) for the liquid toner concentration detecting device shown in FIG. 3. This embodiment will be a description of the configuration in which the lower the concentration of the liquid toner, the greater will be the amount of reflected light returning to the reflective photo sensor 708, and the larger the signal which can be obtained from the reflective photo sensor 708.

The signal obtained from the reflective photo sensor 708 shown in FIG. 3 is amplified by the amplifying circuit 720 provided in the reflective photo sensor 708 or in the control circuit 709, and the high frequency component in the signal is removed by the low-pass filter.

Next, signal samples are taken at predetermined intervals of time, and the signal values are averaged. In the event that the average signal value exceeds the upper tolerance limit, the concentration of the liquid toner will be determined to have decreased. Thus, the valve 711 shown in FIG. 3 is released for a predetermined time, concentrated toner is supplied to the casing 704 from the concentrated toner tank 710, and the signal amplification process, low-pass filter process, and the averaging of the signal values, are repeated.

In the event that the average signal value is lower than the upper tolerance limit, it is then determined whether the average signal value exceeds the lower tolerance limit. If the average signal value is less than the lower tolerance limit, the concentration of the liquid toner will be determined to have increased. Thus, the valve 713 shown in FIG. 3 is released for the predetermined time, carrier liquid is supplied to the casing 704 from the carrier liquid tank 712, and the signal amplification process, low-pass filter process, and the averaging of the signal values, are repeated.

The carrier liquid or concentrated toner supplied in accordance with the aforementioned controls is mixed with the liquid toner inside the casing 704 by means of the agitating screw 705 and the agitating roller 706, and by repeating the aforementioned controls, the concentration of the liquid toner inside the casing 704 is maintained within the predetermined range.

The method of controlling the concentration of this embodiment can also be applied to the liquid toner concentration detecting device described in FIGS. 4, 5B, 6, 8 and 9. In this case, however, the sampling need be carried out in synchronization with the rotating frequency of the agitating roller 706*a* shown in FIG. 4, the agitating roller 706 shown in FIG. 5B, the agitator 303 shown in FIG. 6, the lifting roller 803 shown in FIG. 8 and the Anilox roller 805 shown in FIG. 9, and thus in a timed relationship capable of obtaining reflected light.

Furthermore, it is sufficient that the reflective photo sensor 708 emits and receives light intermittently, when conducting sampling only. By conducting intermittent operation, deterioration due to age of the reflective photo sensor 708 can be prevented, thus enabling continuous, accurate liquid toner concentration control.

With such a configuration, it is sufficient that the reflective photo sensor be operated intermittently, when conducting sampling only, thus preventing deterioration due to age of the reflective photo sensor and enabling continuous, accurate liquid toner concentration control.

FIG. 9 is a flowchart illustrating a method of controlling a concentration of the liquid toner (part 3) for the liquid toner concentration detecting device described in FIG. 3. This embodiment will be a description of the configuration in which the lower the concentration of the liquid toner, the greater will be the amount of reflected light returning to the reflective photo sensor 708, and the larger the signal which can be obtained from the reflective photo sensor 708.

The signal obtained from the reflective photo sensor 708 shown in FIG. 3 is amplified by the amplifying circuit 720 provided in the reflective photo sensor 708 or in the control circuit 709, and the high frequency component in the signal is removed by the low-pass filter.

Next, the difference between the signal value and a pre-set standard value is calculated, and the difference value is integrated within an arbitrary unit time. In the event that the integrated value exceeds the upper tolerance limit, the concentration of the liquid toner will be determined to have decreased. Thus, the valve 711 shown in FIG. 3 is released for a predetermined time, concentrated toner is supplied to the casing 704 from the concentrated toner tank 710, and the signal amplification process, low-pass filter process, and integration of the difference value within the unit time, are repeated.

In the event that the integrated value is less than the upper tolerance limit, it is then determined whether the integrated value exceeds the lower tolerance limit. If the integrated value is less than the lower tolerance limit, the concentration of the liquid toner will be determined to have increased. Thus, the valve 713 shown in FIG. 3 is released for a predetermined time, carrier liquid is supplied to the casing 704 from the carrier liquid tank 712, and the signal amplification process, low-pass filter process, and integration of the difference value within the unit time, are repeated.

The carrier liquid or concentrated toner supplied in accordance with the aforementioned controls is mixed with the liquid toner inside the casing 704 by means of the agitating screw 705 and the agitating roller 706, and by repeating the aforementioned controls, the concentration of the liquid toner inside the casing 704 is maintained within the predetermined range.

The method of controlling the concentration of this embodiment can also be applied to the liquid toner concentration detecting device described in FIGS. 4, 5B, 6, 8 and 9. In this case, however, the aforementioned control need be exerted in synchronization with the rotating frequency of the agitating roller 706*a* shown in FIG. 4, the agitating roller 706 shown in FIG. 5B, the agitator 303 shown in FIG. 6, the lifting roller 803 shown in FIG. 8 and the Anilox roller 805 shown in FIG. 9, and thus in a timed relationship capable of obtaining reflected light.

In the case of this embodiment, the difference calculation is conducted before the integration calculation, but it is possible to omit this difference calculation. With such a configuration, it is possible to conduct continuous liquid toner concentration control. For example, it is possible to accurately control the liquid toner concentration at the time of conducting the initial setting of liquid toner concentration when starting up the image forming apparatus.

Figure 14:
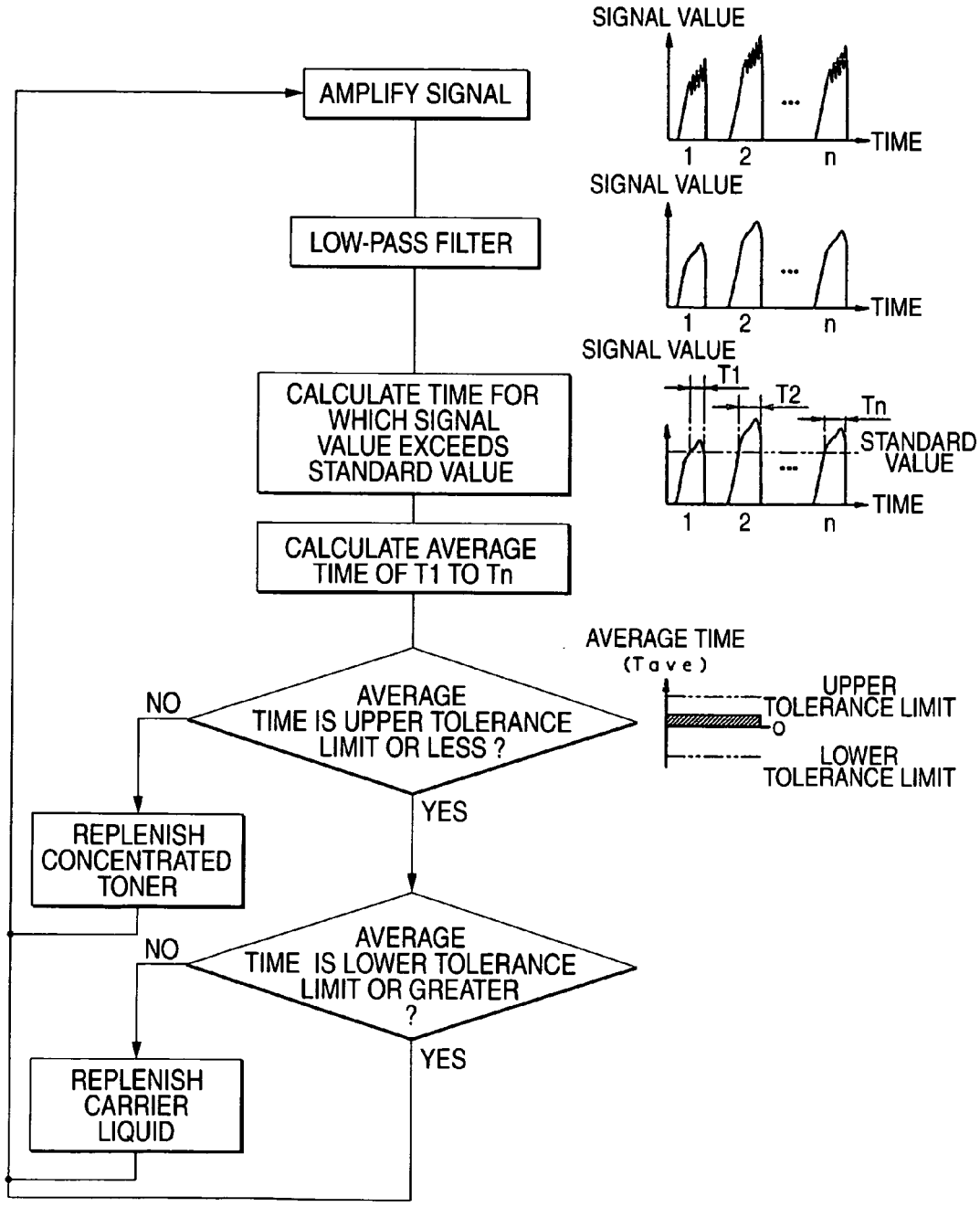
FIG. 14 is a flowchart illustrating a liquid toner concentration control method for the liquid toner concentration detecting device shown in FIG. 6.

FIG. 14 is a flowchart illustrating a method of controlling a concentration of the liquid toner for the liquid toner concentration detecting device shown in FIG. 6. This embodiment will be a description of the configuration in which the lower the concentration of the liquid toner, the greater will be the amount of reflected light returning to the reflective photo sensor 708, and the larger the signal which can be obtained from the reflective photo sensor 708.

The signal obtained from the reflective photo sensor 708 shown in FIG. 6 is amplified by the amplifying circuit 720 provided in the reflective photo sensor 708 or in the control circuit 709, and the high frequency component in the signal is removed by the low-pass filter.

Next, times T1, T2 and Tn for which the signal value exceeds a pre-set standard value are detected, and the average of times T1, T2 and Tn is calculated.

In the event that the calculated average time exceeds the upper tolerance time limit, the concentration of the liquid toner will be determined to have decreased. Thus, the pump P2 shown in FIG. 6 is operated for a predetermined time, carrier liquid is supplied to the primary reservoir 315 in the container 320 from the carrier liquid tank 712, and the signal amplification process, low-pass filter process, and calculation of the T1, T2 and Tn average time are repeated.

In the event that the calculated average time is less than the upper tolerance time limit, it is then determined whether the average time exceeds the lower tolerance time limit. If the average time is less than the lower tolerance time limit, the concentration of the liquid toner will be determined to have increased. Thus, the pump P1 shown in FIG. 6 is operated for a predetermined time, carrier liquid is supplied to the primary reservoir 315 in the container 320 from the carrier liquid tank 712, and the signal amplification process, low-pass filter process, and calculation of the T1, T2 and Tn average time are repeated.

The carrier liquid or concentrated toner supplied in accordance with the aforementioned controls is mixed with the liquid toner inside container 302 by means of the agitator 303 and plate-shaped agitating member 304, and by repeating the aforementioned controls, the concentration of the liquid toner inside the container 302 is maintained within the predetermined range. Furthermore, in the case of this embodiment, the average time by which the signal value of the reflective photo sensor 708 exceeds the pre-set standard value is calculated, but it is also possible to exert control using the total time by which it exceeds the pre-set standard value.

What is claimed is:

1. A liquid toner concentration detecting device comprising:

a first container, operable to accommodate a liquid toner, and provided with a window;

a reflector, disposed in the first container;

a light emitter, operable to emit light to the reflector through the window and the liquid toner;

a light receiver, operable to receive the light reflected by the reflector through the liquid and the window; and a detector, operable to detect a concentration of the liquid toner based on the light received by the light receiver, wherein the first container is communicated with a development device, which has a second container adapted to accommodate the liquid toner and a developer causing the liquid toner to adhere onto an image carrier to develop an electrostatic latent image formed on the image carrier as a toner image, the first container is identical with the second container, a supply roller is formed with a groove adapted to accommodate the liquid toner and is operable to supply the liquid toner to the developer, and a part of the supply roller, not having the groove, serves as the reflector.

2. The liquid toner concentration detecting device according to claim 1, wherein the reflector is rotatable.

3. The liquid toner concentration detecting device according to claim 1, wherein the first container has a first surface provided with the window, the reflector has a second surface, a curvature of the first surface is different from a curvature of the second surface, the window of the first surface is adjacent to the second surface, and the light emitter and the light receiver face the window.

4. The liquid toner concentration detecting device according to claim 1, wherein the reflector has a slider operable to be brought in sliding contact with the window.

5. The liquid toner concentration detecting device according to claim 1, wherein the reflector is operable to agitate the liquid toner in the first container.

6. The liquid toner concentration detecting device according to claim 1, wherein the first container is communicated with the second container through a flow path.

7. The liquid toner concentration detecting device according to claim 1, wherein the first container is communicated with a first tank adapted to store a first liquid, and the first container is communicated with a second tank adapted to store a second liquid.

8. The liquid toner concentration detecting device according to claim 7, the first liquid is a concentrated toner, and the second liquid is a carrier liquid.

9. The liquid toner concentration detecting device according to claim 1, wherein the reflector is operable to supply the liquid toner to the developer.

10. An image forming apparatus in which an electrostatic latent image formed on an image carrier is developed as toner image, the image forming apparatus comprising the liquid toner concentration detecting device according to claim 1.

11. A method of controlling concentration of liquid toner comprising:

providing the liquid toner concentration detecting device according to claim 1;

detecting a signal, which shows the concentration of the liquid toner and is generated by the detector;

counting a number of first times a value of each of a plurality of the signals exceeds a preset upper limit within a predetermined time period;

counting a number of second times a value of each of plurality of the signals exceeds a preset lower limit within the predetermined time period;

supplying the first container with a concentrated toner in a case where the number of the first times is greater than a predetermined number of times; and supplying the first container with a carrier liquid in a case where the number of the first times is no more than the predetermined number of times and the number of the second times is greater than the predetermined number of times.

12. A method of controlling concentration of liquid toner comprising:

providing the liquid toner concentration detecting device according to claim 1;

detecting a signal, which shows the concentration of the liquid toner and is generated by the detector, within a predetermined time period;

calculating an average value of values of a plurality of the signal;

supplying the first container with a concentrated toner in a case where the average value is greater than a preset upper limit; and supplying the first container with a carrier liquid in a case where the average value is no more than the preset upper limit and the average value is less than a preset lower limit.

13. A method of controlling concentration of liquid toner comprising:

providing the liquid toner concentration detecting device according to claim 1;

detecting a signal, which shows the concentration of the liquid toner and is generated by the detector, within a predetermined time period;

calculating an integrated value of values of a plurality of the signal;

supplying the first container with a concentrated toner in a case where the integrated value is greater than a preset upper limit; and supplying the first container with a carrier liquid in a case where the integrated value is no more than the preset upper limit and the integrated value is less than a preset lower limit.

14. A method of controlling concentration of liquid toner comprising:

providing the liquid toner concentration detecting device according to claim 1;

detecting a signal, which shows the concentration of the liquid toner and is generated by the detector;

detecting a time period for which a value of the signal is greater than a standard value;

calculating an average time period of a plurality of the time period;

supplying the first container with a concentrated toner in a case where the average time period is greatest than a preset upper limit; and supplying the first container with a carrier liquid in a case where the average time period is no more than the preset upper limit and the average time period is less than a preset lower limit.

15. A method of controlling concentration of liquid toner comprising:

providing the liquid toner concentration detecting device according to claim 1;

detecting a signal, which shows the concentration of the liquid toner and is generated by the detector;

detecting a time period for which a value of the signal is greater than a standard value;

calculating a total time period of a plurality of the time period;

supplying the first container with a concentrated toner in a case where the total time period is greater than a preset upper limit; and supplying the first container with a carrier liquid in a case where the total time period is no more than the preset upper limit and the total time period is less than a preset lower limit.

* * * * *